US011735122B2

(12) United States Patent
Kim et al.

(10) Patent No.: US 11,735,122 B2
(45) Date of Patent: Aug. 22, 2023

(54) DISPLAY DEVICE, CONTROLLER, AND DISPLAY DRIVING METHOD

(71) Applicant: LG Display Co., Ltd., Seoul (KR)

(72) Inventors: Juwon Kim, Gyeonggi-do (KR); Mookyoung Hong, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/525,172

(22) Filed: Nov. 12, 2021

(65) Prior Publication Data

US 2022/0180815 A1 Jun. 9, 2022

(30) Foreign Application Priority Data

Dec. 7, 2020 (KR) ..... 10-2020-0169286

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2300/0842* (2013.01); *G09G 2310/0278* (2013.01); *G09G 2310/08* (2013.01); *G09G 2320/041* (2013.01)

(58) Field of Classification Search
None
See application file for complete search history.

(56) References Cited

U.S. PATENT DOCUMENTS

2006/0202630 A1* 9/2006 Yamada ..... G09G 3/3208 315/169.2
2007/0085798 A1* 4/2007 Hashimoto ..... G09G 3/3648 345/93
2010/0309175 A1* 12/2010 Ohtsuki ..... G09G 3/3648 345/204
2013/0147694 A1* 6/2013 Kim ..... G09G 3/3233 345/82
2018/0033381 A1* 2/2018 Hwang ..... G09G 3/3677
2019/0066621 A1* 2/2019 Im ..... G09G 3/3696
2019/0103072 A1* 4/2019 Li ..... G09G 3/36
2019/0347972 A1* 11/2019 Kim ..... G09G 3/3614
2022/0044641 A1* 2/2022 Park ..... G09G 3/3275
2022/0157257 A1* 5/2022 Kim ..... G09G 3/3275

* cited by examiner

*Primary Examiner* — Nitin Patel
*Assistant Examiner* — Amen W Bogale
(74) *Attorney, Agent, or Firm* — Birch, Stewart, Kolasch & Birch, LLP

(57) ABSTRACT

Embodiments of the present disclosure relate to display devices, controllers, and display driving methods for compensating for a difference between respective charges of sub-pixels disposed in different locations in a high temperature condition, and preventing image quality caused by such a charge difference from being degraded.

19 Claims, 24 Drawing Sheets

DISPLAY DEVICE, CONTROLLER, AND DISPLAY DRIVING METHOD

CROSS-REFERENCE TO RELATED APPLICATION

This application claims the priority benefit to Korean Patent Application No. 10-2020-0169286, filed on Dec. 7, 2020 in the Korean Intellectual Property Office, the entire contents of which are incorporated herein by reference in its entirety into the present application.

BACKGROUND

Field of the Disclosure

The present disclosure relates to display devices, controllers, and display driving methods.

Description of the Background

As the advent of information society, there have been growing needs for display devices for displaying images. To meet such needs, recently, various types of display devices, such as a Liquid Crystal Display (LCD) device, an Electroluminescence Display (ELD) device including a Quantum-dot Light Emitting Display device, and an Organic Light Emitting Display (e.g., OLED) device, and the like, have been developed and widely used. Generally, display devices charges a capacitor disposed in each of a plurality of sub-pixels arranged in a display panel and use the charged capacitance for display driving.

However, in such typical display devices, such a capacitor in each sub-pixel can suffer from insufficient charging, and thereby, image quality can become poor. In particular, as the size of panels increases, the delay of corresponding data signals and gate signals can become longer, and in turn, the amount of charge stored in the capacitor can become more insufficient.

In an effort to overcome the lack of charge in each sub-pixel, various approaches have been developed and used. In spite of such attempts, insufficient charging of the sub-pixels has not been completely resolved and can continue to occur, and in turn, a difference between respective charges of the sub-pixels can also be caused. In particular, in a high temperature condition, a difference between respective charges of sub-pixels tends to become more severe.

SUMMARY OF THE DISCLOSURE

Embodiments of the present disclosure provide display devices, controllers, and display driving methods for compensating for a difference between respective charges of sub-pixels.

Embodiments of the present disclosure provide display devices, controllers, and display driving methods for compensating for a difference between respective charges of sub-pixels that is made in a high temperature condition.

Embodiments of the present disclosure provide display devices, controllers, and display driving methods for compensating for a difference between respective charges of sub-pixels disposed in different locations.

According to aspects of the present disclosure, a display device is provided that includes a display panel, in which a plurality of data lines and a plurality of gate lines are disposed, including a plurality of sub-pixels, a data driving circuit outputting data signals to the plurality of data lines according to data driving timing control signals, a gate driving circuit outputting scan pulses to the plurality of gate lines according to gate driving timing control signals, and a controller supplying the data driving timing control signals to the data driving circuit and supplying the gate driving timing control signals to the gate driving circuit.

The plurality of sub-pixels can include a first sub-pixel and a second sub-pixel disposed in different locations, and the first sub-pixel and the second sub-pixel can be disposed in different sub-pixel rows or columns.

When an event occurs in which an ambient temperature rises to a threshold temperature or more, or a difference between respective charging times of the first sub-pixel and the second sub-pixel exists, a first pulse width of a first scan pulse output from the gate driving circuit to a first gate line connected to the first sub-pixel and a second pulse width of a second scan pulse output from the gate driving circuit to a second gate line connected to the second sub-pixel can be different from each other, or only one of a first timing at which a first data signal to be supplied to the first sub-pixel is output from the data driving circuit and a second timing at which a second data signal to be supplied to the second sub-pixel is outputted from the data driving circuit can be changed according to the occurrence of the event, or while the first timing and the second timing are changed according to the occurrence of the event, the amount of change of the first timing can be different from the amount of change of the second timing.

When the first sub-pixel among the first sub-pixel and the second sub-pixel is located farther away from the data driving circuit or located in a more outer edge, the first pulse width of the first scan pulse output from the gate driving circuit to the first gate line connected to the first sub-pixel can be longer than the second pulse width of the second scan pulse output from the gate driving circuit to the second gate line connected to the second sub-pixel.

When the first sub-pixel among the first sub-pixel and the second sub-pixel is located farther away from the data driving circuit or located in a more outer edge, only the first timing among the first timing and the second timing can be advanced according to the occurrence of the event, or while the first timing and the second timing are advanced, the first timing can be more advanced than the second timing.

A difference between a charging time of the first sub-pixel and a charging time of the second sub-pixel when an ambient temperature rises to a threshold temperature or more can be bigger than a difference between a charging time of the first sub-pixel and a charging time of the second sub-pixel when the ambient temperature is less than the threshold temperature.

The display device can further include a temperature sensor that senses a temperature of the display panel and outputs information on the sensed temperature, and a monitoring circuit that monitors whether an ambient temperature rises to the threshold temperature or more based on the sensed temperature information and outputs a control command signal.

The display device can further include a memory in which two or more lookup tables corresponding to different temperature conditions are stored.

Each of the two or more lookup tables can include information on at least one value of at least one charge difference compensation control parameter corresponding to a difference between respective pulse widths of scan pulses or a difference between respective output timings of data signals in a corresponding temperature condition.

The controller can determine a difference between a first pulse width of a first scan pulse and a second pulse width of a second scan pulse by using a lookup table corresponding to an ambient temperature among the two or more lookup tables, determine the amount of change of one of a first timing and a second timing, or determine a difference between the amount of change of the first timing and the amount of change of the second timing.

Through the monitoring circuit, the display device can sense a charging time for each area in the display panel, and when it is determined that respective charging times of the first and second sub-pixels are different from each other based on the sensed result, output a control command signal by determining that an ambient temperature has risen to the threshold temperature or more.

The display device can further include an analog-to-digital converter for sensing a voltage of a first data line connected to the first sub-pixel, and a charge sensing control switch for controlling a connection between the analog-to-digital converter and the first data line.

A sensing mode period for sensing a charging time of the first sub-pixel can include a first duration in which a first scan pulse is supplied to the first sub-pixel, a second duration in which a first data signal is supplied to the first sub-pixel, and a third duration in which after the first data signal is supplied to the first sub-pixel, and a predetermined sensing time passes, the charge sensing control switch becomes turned on, and the analog-to-digital converter senses the voltage of the first data line.

During the third duration, the voltage sensed by the analog-to-digital converter can correspond to the amount of charge of the first sub-pixel.

When an ambient temperature rises to the threshold temperature or more, the controller can output a changed gate driving timing control signal, and thereby cause the first pulse width of the first scan pulse supplied to the first sub-pixel and the second pulse width of the second scan pulse supplied to the second sub-pixel to be different from each other.

The controller can output a changed pulse timing resulting from changing a pulse timing of at least one of a generation clock signal and a modulation clock signal as a gate driving timing control signal, and thereby, cause the first pulse width and the second pulse width to be different.

When an ambient temperature rises to the threshold temperature or more, the controller can output a changed data driving timing control signal, and thereby, cause only one of the first timing and the second timing to be changed according to the occurrence of the event, or cause the amount of change of the first timing and the amount of change of the second timing to be different while the first timing and the second timing are changed according to the occurrence of the event.

The controller can output a changed pulse timing resulting from changing a pulse timing of a source output enable signal as a data driving timing control signal, and thereby, cause only one of the first timing and the second timing to be changed according to the occurrence of the event, or cause the amount of change of the first timing and the amount of change of the second timing to be different while the first timing and the second timing are changed according to the occurrence of the event.

According to aspects of the present disclosure, a controller is provided that includes a signal output circuit that outputs a gate driving timing control signal to a gate driving circuit and outputs a data driving timing control signal to a data driving circuit, and a signal adjustment circuit that adjusts the gate driving timing control signal or the data driving timing control signal when an event occurs in which an ambient temperature is higher than or equal to a threshold temperature, or a difference between a charging time of a first sub-pixel of a plurality of sub-pixels and a charging time of a second sub-pixel thereof exists.

When the gate driving timing control signal is adjusted, a first pulse width of a first scan pulse output from the gate driving circuit to be supplied to the first sub-pixel of the plurality of sub-pixels disposed in a display panel and a second pulse width of a second scan pulse output from the gate driving circuit to be supplied to the second sub-pixel disposed at a different location from the first sub-pixel among the plurality of sub-pixels disposed in the display panel can be different from each other.

When the data driving timing control signal is adjusted, only one of a first timing at which a first data signal to be supplied to the first sub-pixel is output from the data driving circuit and a second timing at which a second data signal to be supplied to the second sub-pixel is output from the data driving circuit can be changed according to the occurrence of the event, or while the first timing and the second timing are changed according to the occurrence of the event, the amount of change of the first timing and the amount of change of the second timing can be different from each other.

According to aspects of the present disclosure, a display device is provided that includes a display panel, in which a plurality of data lines and a plurality of gate lines are disposed, including a plurality of sub-pixels, a data driving circuit outputting data signals to the plurality of data lines according to data driving timing control signals, a gate driving circuit outputting scan pulses to the plurality of gate lines according to gate driving timing control signals, and a controller supplying the data driving timing control signals to the data driving circuit and supplying the gate driving timing control signals to the gate driving circuit.

When an ambient temperature rises to a predetermined degree or more, a pulse width of a scan pulse supplied to a first sub-pixel of the plurality of sub-pixels (a first scan pulse output from the gate driving circuit to a first gate line connected to the first sub-pixel) can increase compared with when the temperature was less than the predetermined degree, or a timing at which a data signal to be supplied to the first sub-pixel is output from the data driving circuit can be advanced compared with when the temperature was less than the predetermined degree.

According to aspects of the present disclosure, a display driving method is provided that includes sensing whether an event occurs in which an ambient temperature is higher than or equal to a threshold temperature, or a difference between respective charging times of two or more sub-pixels of a plurality of sub-pixels exists, and supplying a first scan pulse and a first data signal to a first sub-pixel of the plurality of sub-pixels and supplying a second scan pulse and a second data signal to a second sub-pixel of the plurality of sub-pixels.

A first pulse width of the first scan pulse supplied to the first sub-pixel (the first scan pulse output from a gate driving circuit to a first gate line connected to the first sub-pixel of the plurality of sub-pixels) and a second pulse width of the second scan pulse supplied to the second sub-pixel (the second scan pulse output from the gate driving circuit to a second gate line connected to the second sub-pixel of the plurality of sub-pixels) can be different from each other, or only one of a first timing at which the first data signal to be supplied to the first sub-pixel is output from a data driving circuit and a second timing at which the second data signal to be supplied to the second sub-pixel is outputted from the data driving circuit can be changed according to the occurrence of the event, or while the first timing and the second timing are changed according to the occurrence of the event, the amount of change of the first timing can be different from the amount of change of the second timing.

When the first sub-pixel among the first sub-pixel and the second sub-pixel is located farther away from the data driving circuit or located in a more outer edge, the first pulse width of the first scan pulse supplied to the first sub-pixel can be longer than the second pulse width of the second scan pulse supplied to the second sub-pixel.

When the first sub-pixel among the first sub-pixel and the second sub-pixel is located farther away from the data driving circuit or located in a more outer edge, only the first timing among the first timing and the second timing can be advanced according to the occurrence of the event, or while the first timing and the second timing are advanced according to the occurrence of the event, the first timing can be more advanced than the second timing.

According to embodiments of the present disclosure, it is possible to provide display devices, controllers, and display driving methods for compensating for a difference between respective charges of sub-pixels.

According to embodiments of the present disclosure, it is possible to provide display devices, controllers, and display driving methods for compensating for a difference between respective charges of sub-pixels that exists in a high temperature condition.

According to embodiments of the present disclosure, it is possible to provide display devices, controllers, and display driving methods for compensating for a difference between respective charges of sub-pixels disposed in different locations.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure. In the drawings.

DETAILED DESCRIPTION OF THE EMBODIMENTS

Figure 1:
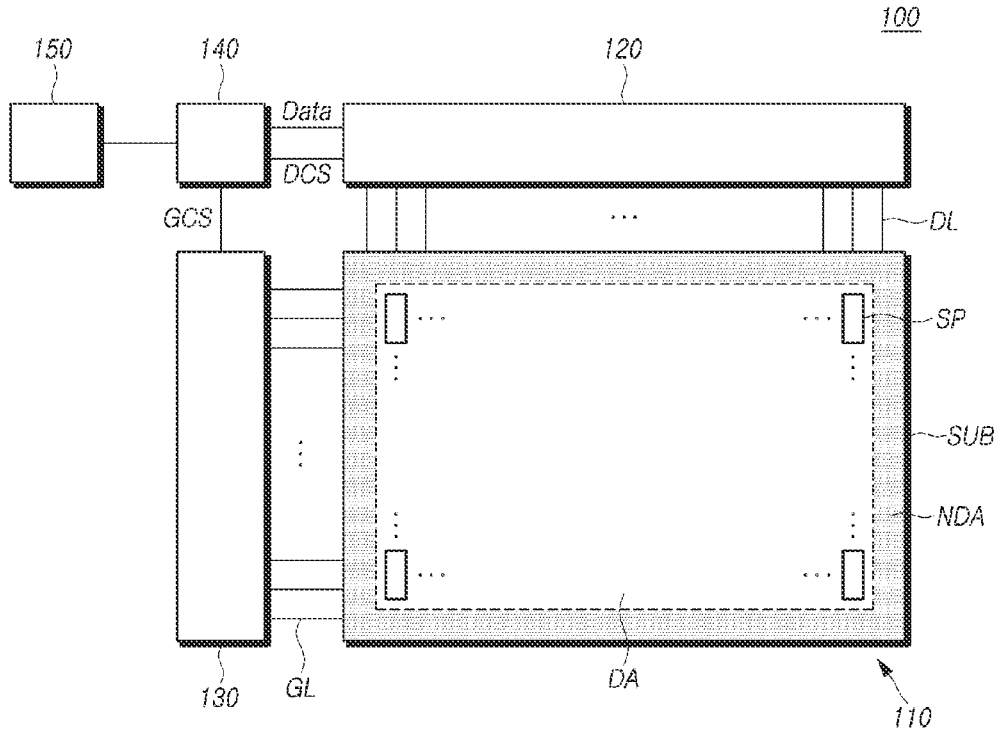
FIG. 1 illustrates a system configuration of a display device according to aspects of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description can make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" can be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element can be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms can be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that can be caused by various factors (e.g., process factors, internal or external impact, noise, etc.) even when a relevant description is not specified. Further, the term "may" fully encompasses all the meanings of the term "can".

FIG. 1 illustrates a system configuration of a display device 100 according to aspects of the present disclosure. All the components of each display device according to all embodiments of the present disclosure are operatively coupled and configured.

Referring to FIG. 1, the display device 100 according to aspects of the present disclosure includes a display panel 110 and a driving circuit for driving the display panel 110.

The driving circuit can include a data driving circuit 120 and a gate driving circuit 130, and can further include a controller 140 that controls the data driving circuit 120 and the gate driving circuit 130.

The display panel 110 can include a substrate SUB and signal lines such as a plurality of data lines DL and a plurality of gate lines GL disposed on or over the substrate SUB. The display panel 110 can include a plurality of sub-pixels SP connected to the plurality of data lines DL and the plurality of gate lines GL.

The display panel 110 can include a display area DA in which an image is displayed and a non-display area NDA in which an image is not displayed. In the display panel 110, the plurality of sub-pixels SP for displaying images are disposed in the display area DA, and the driving circuits 120, 130, and 140 can be electrically connected to, or mounted in, the non-display area NDA. Further, a pad portion to which an integrated circuit or a printed circuit is connected can be disposed on the non-display area NDA.

The data driving circuit 120 is a circuit for driving the plurality of data lines DL, and can supply data signals to the plurality of data lines DL. The gate driving circuit 130 is a circuit for driving the plurality of gate lines GL, and can supply gate signals to the plurality of gate lines GL. The controller 140 can supply a data driving timing control signal DCS to the data driving circuit 120 to control an operation timing of the data driving circuit 120. The controller 140 can supply a gate driving timing control signal GCS to the gate driving circuit 130 to control an operation timing of the gate driving circuit 130.

The controller 140 starts a scanning operation according to timings scheduled in each frame, converts image data inputted from other devices or other image providing sources to a data signal type used in the data driving circuit 120 and then supplies image data DATA resulting from the converting to the data driving circuit 120, and controls the loading of the data to at least one pixel at a pre-configured time according to a scan timing.

The controller 140 can receive, in addition to input image data, several types of timing signals including a vertical synchronous signal VSYNC, a horizontal synchronous signal HSYNC, an input data enable signal DE, a clock signal CLK, and the like from other devices, networks, or systems (e.g., a host system 150).

In order to control the data driving circuit 120 and the gate driving circuit 130, the controller 140 can receive one or more of the timing signals such as the vertical synchronization signal VSYNC, the horizontal synchronization signal HSYNC, the input data enable signal DE, the clock signal CLK, and the like, generate several types of control signals DCS and GCS, and output the generated signals to the data driving circuit 120 and the gate driving circuit 130.

For example, in order to control the gate driving circuit 130, the controller 140 can output various types of gate driving timing control signals GCS including a gate start pulse GSP, a gate shift clock GSC, a gate output enable signal GOE, and the like.

In order to control the data driving circuit 120, the controller 140 can output various types of data driving timing control signals DCS including a source start pulse SSP, a source sampling clock SSC, and the like.

The controller 140 can be implemented in a separate component from the data driving circuit 120, or integrated with the data driving circuit 120 and implemented into an integrated circuit.

The data driving circuit 120 can drive a plurality of data lines DL by receiving image data Data from the controller 140 and supplying data signals to the plurality of data lines DL. Here, the data driving circuit 120 can also be referred to as a source driving circuit.

The data driving circuit 120 can include one or more source driver integrated circuits SDIC.

Each source driver integrated circuit SDIC can include a shift register, a latch circuit, a digital-to-analog converter DAC, an output buffer, and the like. In some instances, each source driver integrated circuit SDIC can further include an analog to digital converter ADC.

In some embodiments, each source driving circuit SDIC can be connected to the display panel 110 in a tape automated bonding (TAB) type, or connected to a conductive pad such as a bonding pad of the display panel 110 in a chip on glass (COG) type or a chip on panel (COP) type, or connected to the display panel 110 in a chip on film (COF) type.

The gate driving circuit 130 can output gate signals of a turn-on level voltage or gate signals of a turn-off level voltage according to the control of the controller 140. The gate driving circuit 130 can sequentially drive a plurality of gate lines GL by sequentially supplying the gate signals of the turn-on level voltage to the plurality of gate lines GL.

In some embodiments, the gate driving circuit 130 can be connected to the display panel 110 in the tape automated bonding (TAB) type, or connected to a conductive pad such as a bonding pad of the display panel 110 in the chip on glass (COG) type or the chip on panel (COP) type, or connected to the display panel 110 in the chip on film (COF) type. In another embodiment, the gate driving circuit 130 can be located in the non-display area NDA of the display panel 110 in a gate in panel (GIP) type. The gate driving circuit 130 can be disposed on or over a substrate SUB, or connected to the substrate SUB. For example, in the case of the GIP type, the gate driving circuit 130 can be disposed in the non-display area NDA of the substrate SUB. The gate driving circuit 130 can be connected to the substrate SUB in the case of the chip on glass (COG) type, the chip on film (COF) type, or the like.

When a specific gate line is asserted by the gate driving circuit 130, the data driving circuit 120 can convert image data DATA received from the controller 140 into data signals in the form of analog signal and supplies the resulting data signals to a plurality of data lines DL.

The data driving circuit 120 can be located on, but not limited to, only one side (e.g., an upper side or a lower side) of the display panel 110. In some embodiments, the data driving circuit 120 can be located on, but not limited to, two sides (e.g., an upper side and a lower side) of the display panel 110 or at least two of four sides of the display panel 110 according to driving schemes, panel design schemes, or the like.

The gate driving circuit 130 can be located on, but not limited to, only one side (e.g., a left side or a right side) of the display panel 110. In some embodiments, the gate driving circuit 130 can be located on, but not limited to, two sides (e.g., a left side and a right side) of the display panel 110 or at least two of four sides of the display panel 110 according to driving schemes, panel design schemes, or the like.

The controller 140 can be a timing controller used in the typical display technology or a control apparatus/device capable of additionally performing other control functionalities in addition to the typical function of the timing controller. In some embodiments, the controller 140 can be one or more other control circuits different from the timing controller, or a circuit or component in the control apparatus/device The controller 140 can be implemented with various circuits or electronic components such as an integrated circuit (IC), a field programmable gate array (FPGA), an application specific integrated circuit (ASIC), a processor, and/or the like.

The controller 140 can be mounted on a printed circuit board, a flexible printed circuit, or the like, and can be electrically connected to the data driving circuit 120 and the gate driving circuit 130 through the printed circuit board, the flexible printed circuit, or the like.

The controller 140 can transmit and receive signals to and from the data driving circuit 120 via one or more predetermined interfaces. In some embodiments, such interfaces can include a low voltage differential signaling (LVDS) interface, an EPI interface, a serial peripheral interface (SPI), and the like.

The controller 140 can include a storage medium such as one or more registers.

The display device 100 according to aspects of the present disclosure can be a display including a backlight unit such as a liquid crystal display device, or the like, or can be a self-emissive display such as an organic light emitting diode (OLED) display, a quantum dot (QD) display, a micro light emitting diode (M-LED) display, and the like.

In case the display device 100 according to aspects of the present disclosure is the OLED display, each sub-pixel SP can include an OLED where the OLED itself emits light as a light emitting element. In case the display device 100 according to aspects of the present disclosure is the QD display, each sub-pixel SP can include a light emitting element including a quantum dot, which is a self-emissive semiconductor crystal. In case the display device 100 according to aspects of the present disclosure is the micro LED display, each sub-pixel SP can include a micro LED where the micro OLED itself emits light and which is based on an inorganic material as a light emitting element.

Figure 2A:
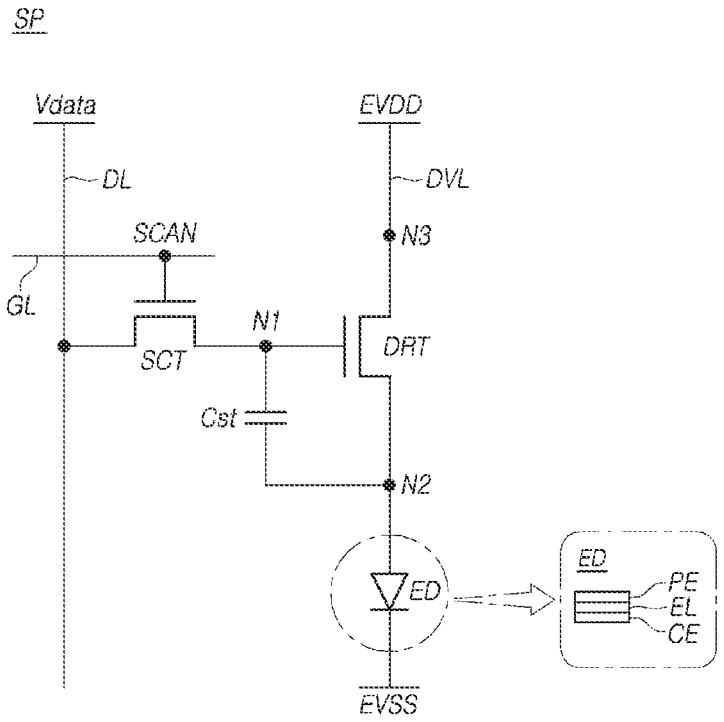
FIGS. 2A and 2B illustrate equivalent circuits for a sub-pixel of the display device according to aspects of the present disclosure.
Figure 2B:
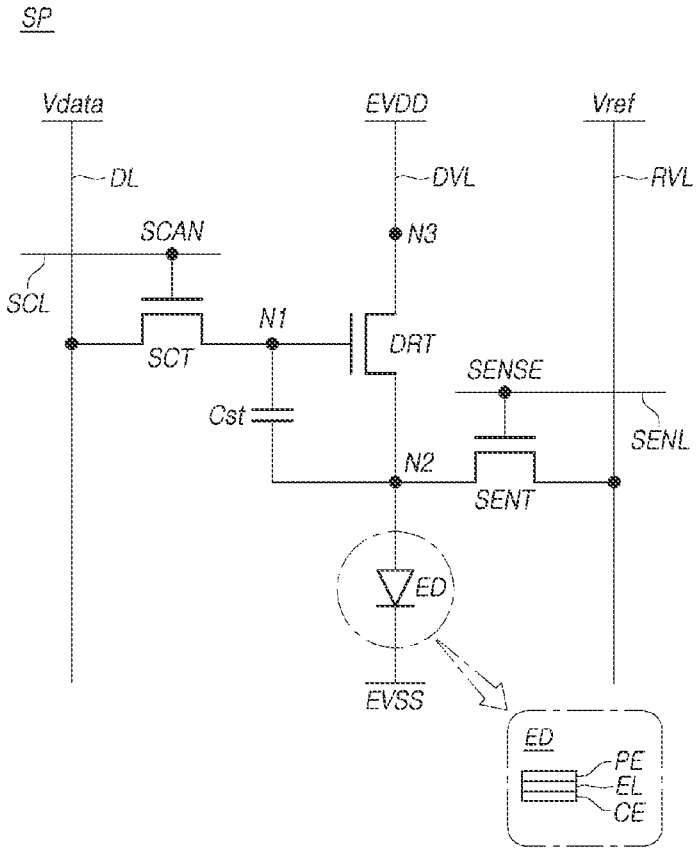

FIGS. 2A and 2B illustrate equivalent circuits for one or more sub-pixels SP in the display device 100 according to aspects of the present disclosure.

Referring to FIG. 2A, each of a plurality of sub-pixels SP disposed in the display panel 110 of the display device 100 according to aspects of the present disclosure can include a light emitting element ED, a driving transistor DRT, and a scan transistor SCT and a storage capacitor Cst.

Referring to FIG. 2A, the light emitting element ED can include a pixel electrode PE and a common electrode CE, and include an emission layer EL located between the pixel electrode PE and the common electrode CE.

The pixel electrode PE of the light emitting element ED can be an electrode disposed in each sub-pixel SP, and the common electrode CE can be an electrode commonly disposed in all sub-pixels SP. Here, the pixel electrode PE can be an anode electrode and the common electrode CE can be a cathode electrode. In another embodiment, the pixel electrode PE can be the anode electrode and the common electrode CE can be the cathode electrode.

In an embodiment, the light emitting element ED can be an organic light emitting diode (OLED), a light emitting diode (LED), a quantum dot light emitting element or the like.

The driving transistor DRT can be a transistor for driving the light emitting element ED, and can include a first node N1, a second node N2, a third node N3, and the like.

The first node N1 of the driving transistor DRT can be a gate node of the driving transistor DRT, and can be electrically connected to a source node or a drain node of the scan transistor SCT. The second node N2 of the driving transistor DRT can be a source node or a drain node of the driving transistor DRT. The second node N2 can be also electrically connected to a source node or a drain node of a sensing transistor SENT, and connected to the pixel electrode PE of the light emitting element ED. The third node N3 of the driving transistor DRT can be electrically connected to a driving voltage line DVL for supplying a driving voltage EVDD.

The scan transistor SCT can be controlled by a scan pulse SCAN, which is a type of gate signal, and can be connected between the first node N1 of the driving transistor DRT and a data line DL. For example, the scan transistor SCT can be turned on or off according to the scan pulse SCAN supplied through a scan signal line SCL, which is a type of the gate line GL, and control a connection between the data line DL and the first node N1 of the driving transistor DRT.

The scan transistor SCT can be turned on by a scan pulse SCAN having a turn-on level voltage, and passes a data signal Vdata supplied through the data line DL to the first node of the driving transistor DRT.

In an embodiment, when the scan transistor SCT is an n-type transistor, the turn-on level voltage of the scan pulse SCAN can be a high level voltage. In another embodiment, when the scan transistor SCT is a p-type transistor, the turn-on level voltage of the scan pulse SCAN can be a low level voltage.

The storage capacitor Cst can be connected between the first node N1 and the second node N2 of the driving transistor DRT. The storage capacitor Cst can store the amount of electric charge corresponding to a voltage difference between both terminals and maintain the voltage difference between both terminals for a predetermined frame time. Accordingly, a corresponding sub-pixel SP can emit light for the predetermined frame time.

Referring to FIG. 2B, each of the plurality of sub-pixels SP disposed in the display panel 110 of the display device 100 according to aspects of the present disclosure can further include a sensing transistor SENT.

The sensing transistor SENT can be controlled by a sense pulse SENSE, which is a type of gate signal, and can be connected between the second node N2 of the driving transistor DRT and a reference voltage line RVL. For example, the sensing transistor SENT can be turned on or off according to the sense pulse SENSE supplied through a sense line SENL, which is another type of the gate line GL, and control an electrical connection between the reference voltage line RVL and the second node N2 of the driving transistor DRT.

The sensing transistor SENT can be turned on by a sense pulse SENSE having a turn-on level voltage, and pass a reference voltage Vref transmitted through the reference voltage line RVL to the second node of the driving transistor DRT.

The sensing transistor SENT can be turned on by the sense pulse SENSE having the turn-on level voltage, and transmit a voltage at the second node N2 of the driving transistor DRT to the reference voltage line RVL.

In an embodiment, when the sensing transistor SENT is an n-type transistor, the turn-on level voltage of the sense pulse SENSE can be a high level voltage. In another embodiment, when the sensing transistor SENT is a p-type transistor, the turn-on level voltage of the sense pulse SENSE can be a low level voltage.

The function of the sensing transistor SENT transmitting the voltage at the second node N2 of the driving transistor DRT to the reference voltage line RVL can be used when driven to sense at least one characteristic value of the sub-pixel SP. In this case, the voltage transmitted to the reference voltage line RVL can be a voltage for calculating the characteristic value of the sub-pixel SP or a voltage in which the characteristic value of the sub-pixel SP is reflected.

Herein, the characteristic value of the sub-pixel SP can be characteristic values of the driving transistor DRT or the light emitting element ED. The characteristic values of the driving transistor DRT can include a threshold voltage and/or mobility of the driving transistor DRT. The characteristic value of the light emitting element ED can include a threshold voltage of the light emitting element ED.

Each of the driving transistor DRT, the scan transistor SCT, and the sensing transistor SENT can be an n-type transistor or a p-type transistor. Herein, for convenience of description, it is assumed that each of the driving transistor DRT, the scan transistor SCT, and the sensing transistor SENT is the n-type transistor.

The storage capacitor Cst can be an external capacitor intentionally designed to be located outside of the driving transistor DRT, other than an internal capacitor, such as a parasitic capacitor (e.g., a Cgs, a Cgd), that can be formed between the gate node and the source node (or drain node) of the driving transistor DRT.

The scan line SCL and the sense line SENL can be different gate lines GL. In some embodiments, the scan pulse SCAN and the sense pulse SENSE can be separate gate signals, and the on-off timing of the scan transistor SCT and the on-off timing of the sensing transistor SENT in one sub-pixel SP can be independent. For example, the on-off timing of the scan transistor SCT and the on-off timing of the sensing transistor SENT in one sub-pixel SP can be equal to, or different from, each other.

In another embodiment, the scan line SCL and the sense line SENL can be the same gate line GL. For example, a gate node of the scan transistor SCT and a gate node of the sensing transistor SENT in one sub-pixel SP can be connected to one gate line GL. In some embodiments, the scan pulse SCAN and the sense pulse SENSE can be the same gate signal, and the on-off timing of the scan transistor SCT and the on-off timing of the sensing transistor SENT in one sub-pixel SP can be the same.

It should be understood that the sub-pixel structures shown in FIGS. 2A and 2B are merely examples of possible sub-pixel structures for convenience of discussion, and embodiments of the present disclosure can be implemented in any of various structures, as desired. For example, the sub-pixel SP can further include at least one transistor and/or at least one capacitor.

Further, discussions on the sub-pixel structures in FIGS. 2A and 2B have been conducted based on the assumption that the display device 100 is a self-emissive display device, and when the display device 100 is a liquid crystal display, each sub-pixel SP can include a transistor, a pixel electrode, and the like.

Figure 3:
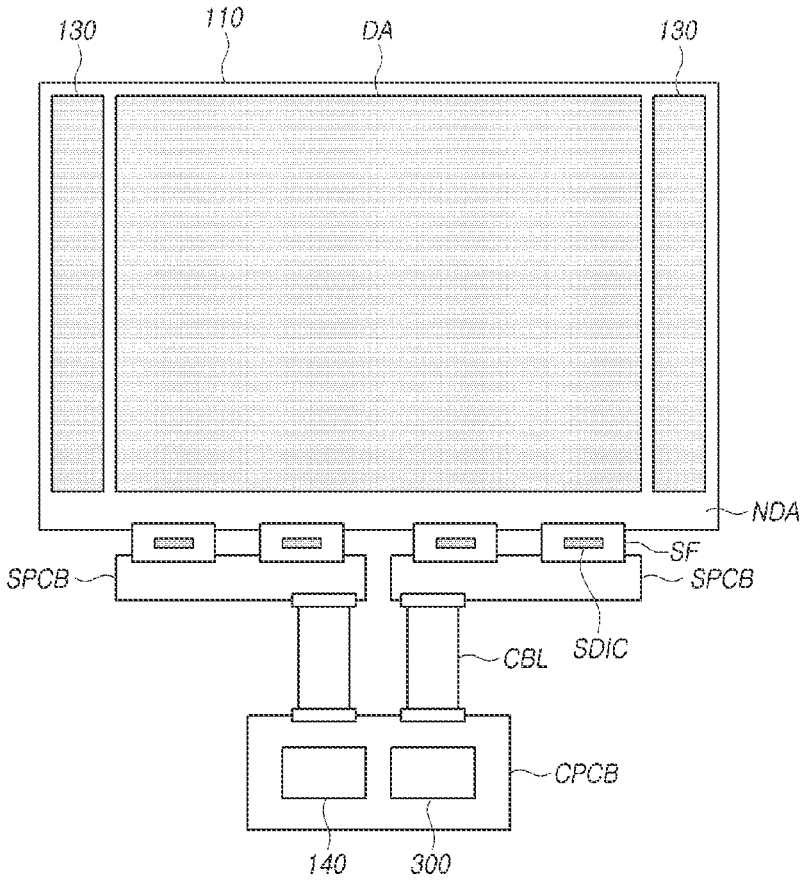
FIG. 3 illustrates an example system implementation of the display device according to aspects of the present disclosure.

FIG. 3 illustrates an example system implementation of the display device 100 according to aspects of the present disclosure.

The display panel 110 can include a display area DA in which an image is displayed and a non-display area NDA in which an image is not displayed.

Referring to FIG. 3, when the data driving circuit 120 includes one or more source driver integrated circuits SDIC and is implemented in the chip on film (COF) type, each source driver integrated circuit SDIC can be mounted on a circuit film SF connected to the non-display area NDA of the display panel 110.

Referring to FIG. 3, the gate driving circuit 130 can be implemented in the gate in panel (GIP) type. In this embodiment, the gate driving circuit 130 can be located in the non-display area NDA of the display panel 110. In another embodiment, unlike the illustration in FIG. 3, the gate driving circuit 130 can be implemented in the chip on film (COF) type.

The display device 100 can include at least one source printed circuit board SPCB for a circuital connection between one or more source driver integrated circuits SDIC and other devices, components, and the like, and a control printed circuit board CPCB on which control components, and various types of electrical devices or components are mounted.

The circuit film SF on which the source driver integrated circuit SDIC is mounted can be connected to at least one source printed circuit board SPCB. For example, one side of the circuit film SF on which the source driver integrated circuit SDIC is mounted can be electrically connected to the display panel 110 and the other side thereof can be electrically connected to the source printed circuit board SPCB.

The controller 140 and the power management integrated circuit PMIC, 300 can be mounted on the control printed circuit board CPCB. The controller 140 can perform an overall control function related to the driving of the display panel 110 and control operations of the data driving circuit 120 and the gate driving circuit 130. The power management integrated circuit 300 can supply various types of voltages or currents to the data driving circuit 120 and the gate driving circuit 130 or control various types of voltages or currents to be supplied.

A circuital connection between the at least one source printed circuit board SPCB and the control printed circuit board CPCB can be performed through at least one connection cable CBL. The connection cable CBL can be, for example, a flexible printed circuit FPC, a flexible flat cable FFC, or the like.

Here, at least one source printed circuit board SPCB and the control printed circuit board CPCB can be integrated and implemented into one printed circuit board.

The display device 100 according to aspects of the present disclosure can further include a level shifter for adjusting a voltage level. In an embodiment, the level shifter can be disposed on the control printed circuit board CPCB or the source printed circuit board SPCB. In the display device 100 according to aspects of the present disclosure, the level shifter can supply signals needed for gate driving to the gate driving circuit 130. In an embodiment, the level shifter can supply a plurality of clock signals to the gate driving circuit 130. Accordingly, the gate driving circuit 130 can supply a plurality of gate signals to a plurality of gate lines GL based on the plurality of clock signals input from the level shifter. The plurality of gate lines GL can carry the gate signals to the sub-pixels SP disposed in the display area DA of the substrate SUB.

Figure 4:
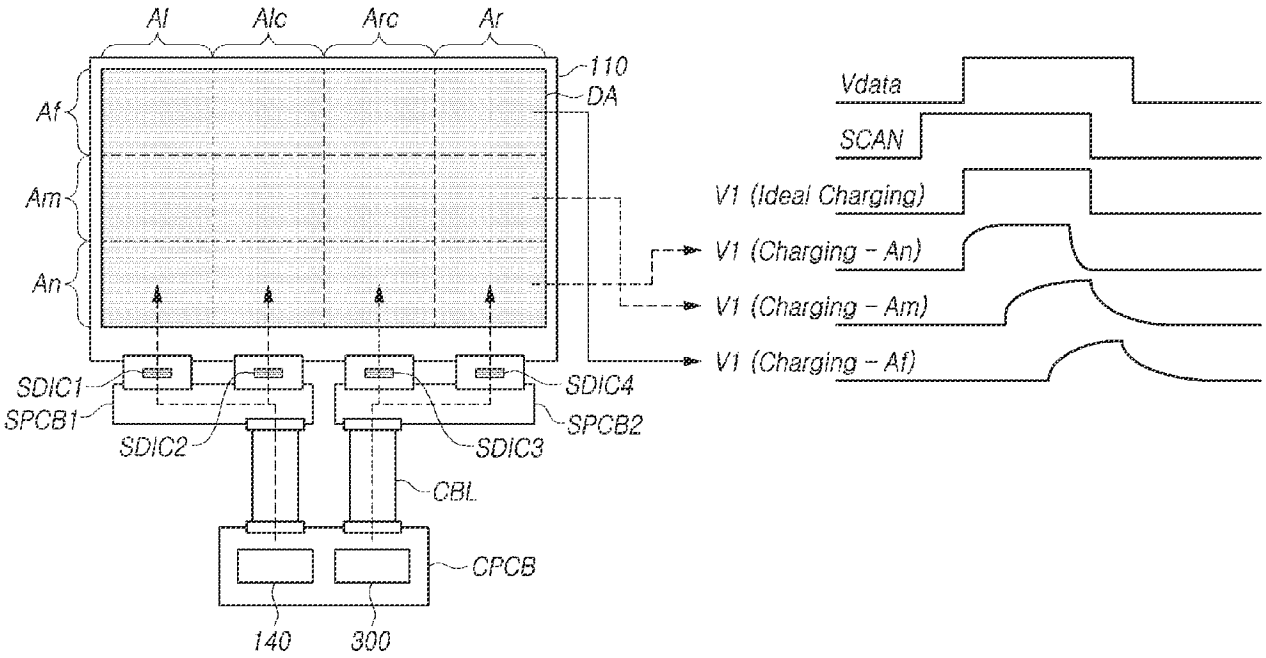
FIG. 4 illustrates a difference between charges in the display device according to aspects of the present disclosure.

FIG. 4 illustrates a difference between charges in the display device 100 according to aspects of the present disclosure.

Referring to FIG. 4, the data driving circuit 120 can include four source driver integrated circuits SDIC1 to SDIC4. Among the four source driver integrated circuits SDIC1 to SDIC4, the first and second source driver integrated circuits SDIC1 and SDIC2 can be connected to a first source printed circuit board SPCB1, and through this, can be electrically connected to the control printed circuit board CPCB. Among the four source driver integrated circuits SDIC1 to SDIC4, the third and fourth source driver integrated circuits SDIC3 and SDIC4 can be connected to a second source printed circuit board SPCB2, and through this, can be electrically connected to the control printed circuit board CPCB.

Referring to FIG. 4, the display area DA of the display panel 110 can include four areas Al, Alc, Arc, and Ar divided into the left and right directions (e.g., the horizontal direction).

The four areas Al, Alc, Arc, and Ar divided into the horizontal direction can include the leftmost area Al located at the leftmost side and the rightmost area Ar located at the rightmost side, and include the left central area Alc and the right central area Arc located between the leftmost area Al and the rightmost area Ar.

Sub-pixels SP disposed in the leftmost area Al can receive data signals Vdata from the first source driver integrated circuit SDIC1. Sub-pixels SP disposed in the left central area Alc can receive data signals Vdata from the second source driver integrated circuit SDIC2. Sub-pixels SP disposed in the right central area Arc can receive data signals Vdata from the third source driver integrated circuit SDIC3. Sub-pixels SP disposed in the rightmost area Ar can receive data signals Vdata from the fourth source driver integrated circuit SDIC4.

Referring to FIG. 4, the display area DA of the display panel 110 can include three areas An, Am, and Af divided into upward and downward directions (e.g., the vertical direction) according to a distance from the data driving circuit 120.

The three areas An, Am, and Af divided into the vertical direction can include the near area An located closest to the data driving circuit 120, the middle area Am spaced apart from the data driving circuit 120 by an intermediate distance, and the far area Af located farthest away from the data driving circuit 120.

Referring to FIG. 4, in order to drive sub-pixels SP disposed in each of the three areas An, Am, and Af in which the display area DA of the display panel 110 is divided into the vertical direction, the gate driving circuit 130 can supply a scan pulse SCAN to a corresponding sub-pixel SP at a predetermined gate driving timing, and the data driving circuit 120 can supply a data signal Vdata to the sub-pixel SP at a predetermined data driving timing. Accordingly, a storage capacitor Cst in the sub-pixel SP can charge up. At this instance, an ideal charging time (a time for which the charging is performed) of the storage capacitor Cst corresponds to a time length of a duration in which a turn-on level voltage duration of a scan pulse SCAN and a duration in which a data signal Vdata is applied overlap each other. Here, when an n-type transistor is employed as the scan transistor SCT, the turn-on level voltage duration of the scan pulse SCAN can be a duration having a high level voltage as shown in FIG. 4. When a p-type transistor is employed as the scan transistor SCT, the turn-on level voltage duration of the scan pulse SCAN can be a duration having a low level voltage as shown in FIG. 4.

Considering the equation (Q=CV) between the amount of electric charge (Q), capacitance (C), and potential difference (V) of the capacitor in the electric circuit, when a sub-pixel SP is driven, the amount of electric charge stored by the storage capacitor Cst can be proportional to a potential difference between both terminals thereof. For example, the amount of electric charge stored by the storage capacitor Cst ("the amount of charge") can be proportional to a potential difference between the first node N1 and the second node N2 of the driving transistor DT. When it is assumed that a constant voltage is applied to the second node N2 of the driving transistor DT, the amount of charge of the storage capacitor Cst can be proportion to a voltage V1 of the first node N1 of the driving transistor DRT, which is one of both terminals of the storage capacitor Cst.

Meanwhile, the three areas An, Am, and Af resulting from dividing the display area DA of the display panel 110 in the vertical direction have different distances from the data driving circuit 120. Accordingly, the times taken for data signals Vdata output from the data driving circuit 120 to reach respective sub-pixels SP disposed in the three areas An, Am, and Af divided into the vertical direction can be different from one another.

Further, the gate driving circuit 130 can receive a gate voltage (including a turn-on level voltage and/or a turn-off level voltage) needed to output a gate signal such as a scan pulse SCAN, and the like from the printed circuit board SPCB shown in FIG. 3 to which the data driving circuit 120 is connected. Accordingly, the times taken for the gate driving circuit 130 to supply scan pulses SCAN to respective sub-pixels SP disposed in the three areas An, Am, and Af divided into the vertical direction can be different from one another.

Referring to FIG. 4, among the three areas An, Am, and Af resulting from dividing the display area DA of the display panel 110 in the vertical direction, a voltage V1 at the first node N1 of a driving transistor DT corresponding to the amount of charge of a sub-pixel SP disposed in the near area An is not significantly different from a voltage V1 corresponding to the amount of ideal charge.

In contrast, among the three areas An, Am, and Af resulting from dividing the display area DA of the display panel 110 in the vertical direction, a voltage V1 at the first node N1 of a driving transistor DT corresponding to the amount of charge of a sub-pixel SP disposed in the middle area Am is significantly different from the voltage V1 corresponding to the amount of ideal charge.

Further, among the three areas An, Am, and Af resulting from dividing the display area DA of the display panel 110 in the vertical direction, a voltage V1 at the first node N1 of a driving transistor DT corresponding to the amount of charge of a sub-pixel SP disposed in the far area Af is most significantly different from the voltage V1 corresponding to the amount of ideal charge.

As described above, due to a difference in signal delays, there can occur a difference in the amount of charge of respective sub-pixels SP disposed in the three areas An, Am, and Af resulting from dividing the display area DA of the display panel 110 in the vertical direction, The connection between the first source printed circuit board SPCB1 and the control printed circuit board CPCB is located closer to the second source driver integrated circuit SDIC2 of the first source driver integrated circuit SDIC1 and the second source driver integrated circuit SDIC2 that are connected to the first source printed circuit board SPCB1. Likewise, the connection between the second source printed circuit board SPCB2 and the control printed circuit board CPCB is located closer to the third source driver integrated circuit SDIC3 of the third source driver integrated circuit SDIC3 and the fourth source driver integrated circuit SDIC4 that are connected to the first source printed circuit board SPCB2. Further, the four source driver integrated circuits SDIC1 to SDIC4 can output various signals using a power supply voltage supplied from the control printed circuit board CPCB.

A signal supplied, to the display panel 110, from each of the first source driver integrated circuit SDIC1 and the fourth source driver integrated circuit SDIC4, which are located on both sides, among the four source driver integrated circuits SDIC1 to SDIC4 outputting various signals using the power supply voltage supplied from the control printed circuit board CPCB can have a delay time longer than a signal supplied, to the display panel 110, from each of the second source driver integrated circuit SDIC2 and the third source driver integrated circuit SDIC3, which are located on intermediate areas, among the four source driver integrated circuits SDIC1 to SDIC4.

For this reason, among the four areas Al, Alc, Arc, and Ar divided into the horizontal direction in the display area DA of the display panel 110, the amount of charge of the sub-pixels SP disposed in the leftmost area Al and the rightmost area Ar can become more insufficient than that of the sub-pixels SP disposed in the left central area Alc and the right central area Arc.

A difference in the amount of charge according to locations of the sub-pixels SP in the display area DA of the display panel 110 as describe above can degrade image quality. Such a difference in the amount of charge according to locations of the sub-pixels SP can become more severe in a situation of a high temperature, and may not be easily solved by the typical display driving control technology.

FIGS. 5A to 5E illustrate abnormal phenomena (510, 520, 530, 540, 550) presented on a screen (hereinafter, referred to as "display artifact(s)") resulting from a difference between charging times in a high temperature condition in the display device 100 according to aspects of the present disclosure.

In a high temperature condition, a difference in signal transmission times can become bigger, and thus, a difference in an amount of charge ("charge difference") according to locations of the sub-pixels SP in the display area DA of the display panel 110 can occur more heavily. Herein, the term "charge difference" means a difference in charging times, a difference in amounts of charge, a difference in charging rates, and/or a meaning similar thereto.

Herein, the term "high temperature" preferably means a temperature higher than a room temperature (e.g., around 15 degrees Celsius), and preferably means a temperature higher than or equal to a preset threshold temperature. Herein, the term "threshold temperature" can be a fixed set value (e.g., 15 degrees Celsius, which can be a normal room temperature), or can be changed and re-configured according to a driving situation or the passage of a driving time. The high temperature condition can be divided into two or more high temperature conditions according to a range of temperature. For example, the temperature condition can include a room temperature condition of less than 15 degrees Celsius, a first high temperature condition of 15 degrees Celsius or more and less than 50 degrees Celsius, and a second high temperature condition of 50 degrees Celsius or more.

Referring to FIGS. 5A to 5E, there can occur display artifacts (510, 520, 530, 540, 550) in the display area DA of the display panel 110 due to charge differences between sub-pixels SP at different locations in a high temperature condition. Due to a difference in arrangements of the divided areas (An, Am, Af, Al, Alc, Arc, and Ar) of the display panel 110, such display artifacts (510, 520, 530, 540, 550) can more severely occur in the leftmost and rightmost areas Al and Ar DA and the far area Af of the display area.

Figure 5A:
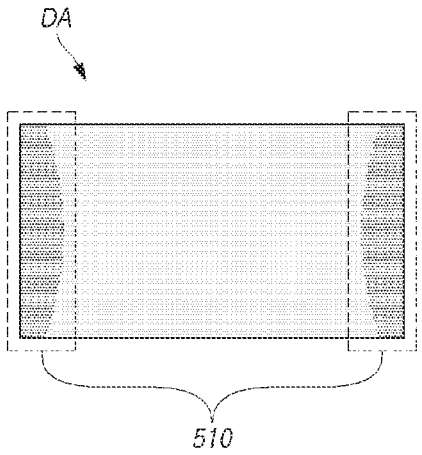
FIGS. 5A to 5E illustrate abnormal phenomena presented on a screen resulting from a difference between charging times in a high temperature condition in the display device according to aspects of the present disclosure.
Figure 5B:
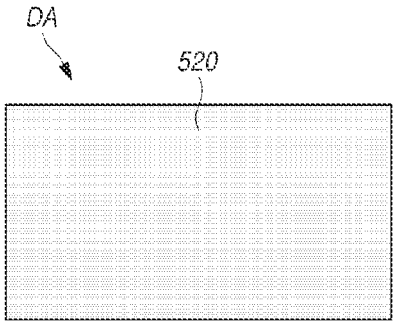
Figure 5C:
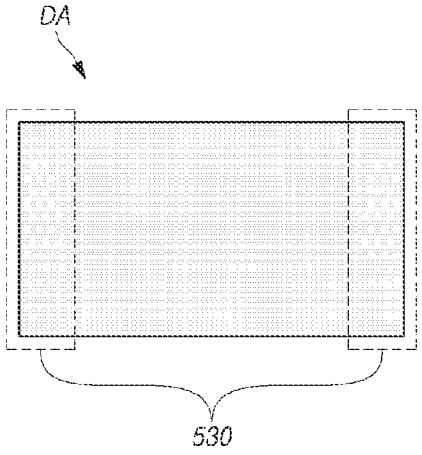
Figure 5D:
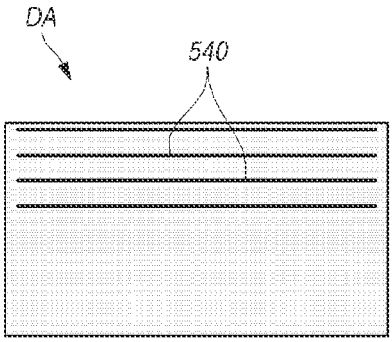
Figure 5E:
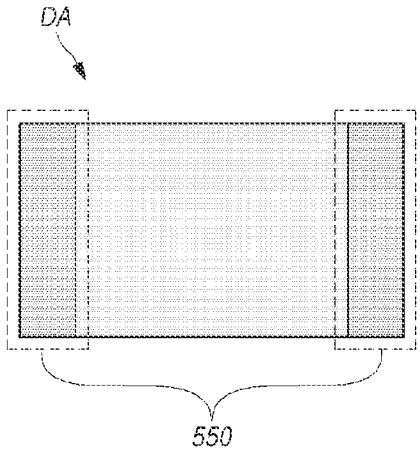

The display artifacts 500 caused by charge differences include, for example, a phenomenon 510 in which left and right sides of the screen are abnormally dark as shown in FIG. 5A, a phenomenon 520 in which an abnormal bright line is present in the far area Af as shown in FIG. 5B, a phenomenon 530 in which a bunch of abnormal dots are present on the left and right sides as shown in FIG. 5C, a phenomenon 540 in which several abnormal dark lines are present in the far area Af as shown in FIG. 5D, and a phenomenon 550 in which blur blocks are present on the left and right sides as shown in FIG. 5E.

Accordingly, embodiments described herein provide techniques for compensating for charge differences of the sub-pixels SP in a high temperature condition. Hereinafter, a method of compensating for charge differences in a high temperature condition and a system therefor will be described in detail. Hereinafter, an amount of charge of the storage capacitor Cst is used as a term corresponding to a charging time and a charging rate. For example, as the charging time increases, the amount of charge can increase and the charging rate can increase. In contrast, as the charging time decreases, the amount of charge can decrease and the charging rate can decrease. Hereinafter, the amount of charging, charging time, and charging rate can be described interchangeably.

Figure 6:
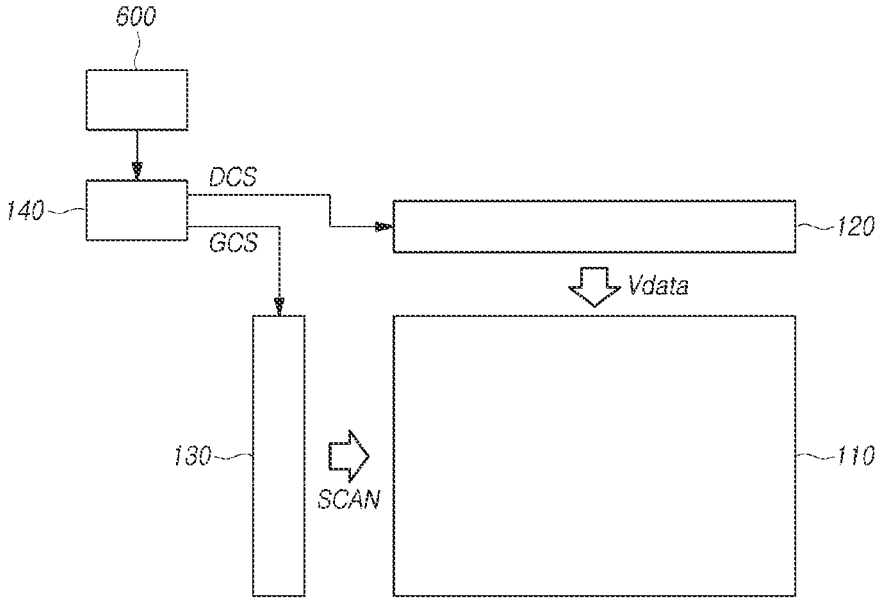
FIG. 6 illustrates a system for compensating for a difference between charges in the display device according to aspects of the present disclosure.

FIG. 6 illustrates a system for compensating for charge differences in the display device 100 according to aspects of the present disclosure.

Referring to FIG. 6, the display device 100 according to aspects of present disclosure can include a display panel 110 in which a plurality of data lines DL and a plurality of gate lines GL are disposed and which includes a plurality of sub-pixels SP, a data driving circuit 120 outputting data signals Vdata to the plurality of data lines DL according to data driving timing control signals DCS, a gate driving circuit 130 outputting scan pulses SCAN to the plurality of gate lines GL according to gate driving timing control signals GCS, and a controller 140 supplying the data driving timing control signals DCS to the data driving circuit 120 and supplying the gate driving timing control signals GCS to the gate driving circuit 130.

Referring to FIG. 6, the charge difference compensation system of the display device 100 according to aspects of present disclosure can compensate for charging differences between sub-pixels SP that can be made in a high temperature condition.

Referring to FIG. 6, the charge difference compensation system can include the data driving circuit 120, the gate driving circuit 130, the controller 140, a sensing circuit 600, and the like.

The controller 140 can perform charge difference compensation control for compensating for charge differences according to temperature. The data driving circuit 120 and the gate driving circuit 130 can drive the display panel 110 to actually compensate for charge differences according to temperature by the charge difference compensation control of the controller 140.

The sensing circuit 600 can sense information needed for enabling the controller 140 to determine whether a charge difference compensation is needed or desired and provide the sensed information to the controller 140.

The charge difference compensation system according to embodiments of the present disclosure can perform a charge difference compensation through at least one of a gate driving control and a data driving control.

Figure 7:
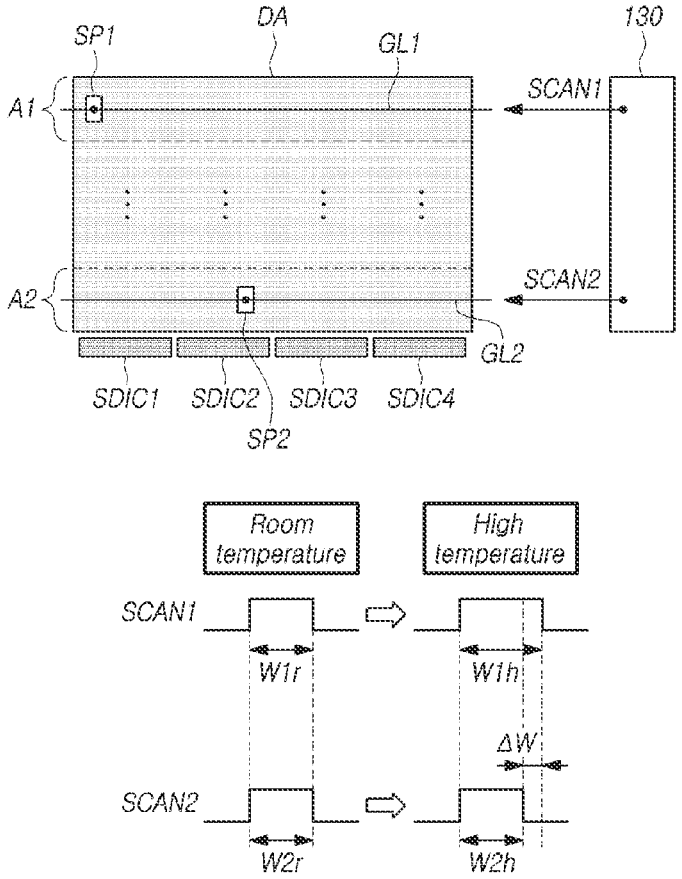
FIG. 7 illustrates a gate driving control for compensating for a difference between charges according to a high temperature condition in the display device according to aspects of the present disclosure.
Figure 8:
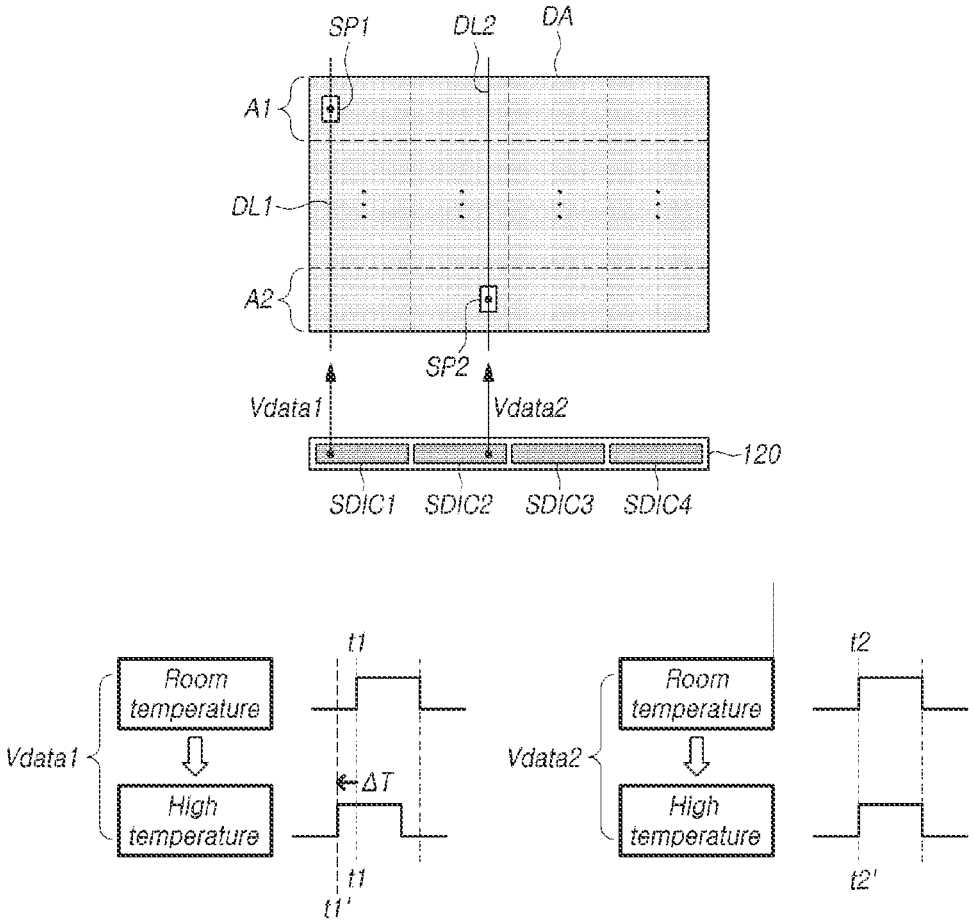
FIG. 8 illustrates a data driving control for compensating for a difference between charges according to a high temperature condition in the display device according to aspects of the present disclosure.

FIG. 7 illustrates a gate driving control for compensating for charge differences according to a high temperature condition in the display device 100 according to aspects of the present disclosure. FIG. 8 illustrates a data driving control for compensating for charge differences according to a high temperature condition in the display device 100 according to aspects of the present disclosure.

FIG. 7 illustrates a first scan pulse SCAN1 and a second scan pulse SCAN2 respectively output by the gate driving circuit 130 to a first gate line GL1 and a second gate line GL2 as the gate driving control (pulse width control) for compensating for charge differences in the high temperature condition is performed. FIG. 8 illustrates a first data signal Vdata1 and a second data signal Vdata2 respectively output by the data driving circuit 120 to a first data line DL1 and a second data line DL2 as the data driving control (output timing control) for compensating for charge differences in the high temperature condition is performed.

Hereinafter, the charge difference compensation will be described based on a first sub-pixel SP1 and a second sub-pixel SP2 included in a plurality of sub-pixels SP disposed in the display panel 110 and disposed at different locations.

The first sub-pixel SP1 and the second sub-pixel SP2 can be disposed in different locations, and disposed in different sub-pixel rows or columns. Accordingly, the first and second sub-pixels SP1 and SP2 can receive a first scan pulse SCAN1 and a second scan pulse SCAN2 output from the gate driving circuit 130 through the first gate line GL1 and the second gate line GL2 which are different from each other, respectively.

The first sub-pixel SP1 can be a sub-pixel SP disposed in the far area A1 located farther away from the source driver integrated circuits SDIC1 to SDIC4 included in the data driving circuit 120. The second sub-pixel SP2 can be a sub-pixel SP disposed in the near area A2 located closer to the source driver integrated circuits SDIC1 to SDIC4 included in the data driving circuit 120.

The first sub-pixel SP1 can be located in a more outer edge of the display area DA than the second sub-pixel SP2. The first sub-pixel SP1 can be located closer to the non-display area NDA than the second sub-pixel SP2.

A difference (charging time difference) between a charging time of the first sub-pixel SP1 and a charging time of the second sub-pixel SP2 when an ambient temperature of the display panel 110 rises to the threshold temperature or more can be bigger than a difference (charging time difference) between the charging time of the first sub-pixel SP1 and the charging time of the second sub-pixel SP2 when the temperature is less than the threshold temperature.

The charge difference compensation system according to embodiments of the present disclosure can perform a charge difference compensation adaptable to an ambient temperature. To do this, locations of sub-pixels SP can be considered. The locations of the sub-pixels SP can include a location related to a distance from the data driving circuit 120 and a location in the left and right directions of the display area DA. In embodiments described herein, the left and right directions and the upward and downward directions are merely for convenience of description, and thus, the left and right directions and the upward and downward directions can be interchanged.

Referring to FIGS. 7 and 8, among the first sub-pixel SP1 and the second sub-pixel SP2 included in the plurality of sub-pixels SP, the first sub-pixel SP1 can be located farther away from the data driving circuit 120 than the second sub-pixel SP2. For example, the first sub-pixel SP1 can be located in a more outer edge of the display area DA than the second sub-pixel SP2.

Referring to FIG. 7, according to the charge difference compensation control of the charge difference compensation system according to embodiments of the present disclosure, a second scan pulse SCAN2 supplied to the second sub-pixel SP2 of the first and second sub-pixels SP1 and SP2 included in the plurality of sub-pixels SP when an ambient temperature rises can have a second pulse width W2*h* substantially equal to, or slightly increased from, a second pulse width W2*r* of the second scan pulse SCAN2 supplied to the second sub-pixel SP2 at the room temperature.

In contrast, a first scan pulse SCAN1 supplied to the first sub-pixel SP1 located farther away from the data driving circuit 120 or in a more outer edge of the display area DA than the second sub-pixel SP2 when the ambient temperature rises can have a first pulse width W1*h* increased from a first pulse width W1*r* of the first scan pulse SCAN1 supplied to the first sub-pixel SP1 at the room temperature.

Referring to FIG. 8, according to the charge difference compensation control of the charge difference compensation system according to embodiments of the present disclosure, since the second sub-pixel SP2 among the first sub-pixel SP1 and the second sub-pixel SP2 is located closer to the data driving circuit 120, a second timing t2' at which a second data signal Vdata2 is output from the data driving circuit 120 to the second data line DL2 when an ambient temperature rises, i.e., at the high temperature, can be substantially equal to, or have a slight difference from, a second timing t2 at which the second data signal Vdata2 is output from the data driving circuit 120 to the second data line DL2 at the room temperature. Here, the timing can preferably mean a delay time based on a vertical synchronization signal.

In contrast, since the first sub-pixel SP1 is located farther away from the data driving circuit 120 or is located in a more outer edge of the display area DA than the second sub-pixel SP2, a first timing t1' at which a first data signal Vdata1 is output from the data driving circuit 120 to the first data line DL1 at the high temperature can be advanced in time by a predetermined amount of change ΔT from a first timing t1 at which the first data signal Vdata1 is output from the data driving circuit 120 to the first data line DL1 at the room temperature.

Herein, the first data signal Vdata1 is a data signal output from the data driving circuit 120 and supplied to the first sub-pixel SP1 through the first data line DL1. The second data signal Vdata2 is a data signal output from the data driving circuit 120 and supplied to the second sub-pixel SP2 through the second data line DL2. Although the first data line DL1 and the second data line DL2 are illustrated as different data lines in FIG. 8, in some embodiments, the first data line DL1 and the second data line DL2 can be the same.

Methods of compensating for charge differences as described above will be described in more detail below.

Referring to FIG. 7, the charge difference compensation system according to embodiments of the present disclosure can implement a charge difference compensation adaptable to an ambient temperature through a gate driving control adaptable to the ambient temperature.

When an ambient temperature is less than a threshold temperature (for example, in a room temperature condition), the charge difference compensation system can implement a gate driving control adaptable to the ambient temperature less than the threshold temperature. Accordingly, a first pulse width W1*r* of the first scan pulse SCAN1 output from the gate driving circuit 130 to the first gate line GL1 to be supplied to the first sub-pixel SP1 and a second pulse width W2*r* of the second scan pulse SCAN output from the gate driving circuit 130 to the second gate line GL2 to be supplied to the second sub-pixel SP2 can be substantially the same (W1*r*=W2*r*).

When the ambient temperature is higher than or equal to the threshold temperature (for example, in a high temperature condition), the charge difference compensation system can implement a gate driving control adaptable to the ambient temperature higher than or equal to the threshold temperature. Accordingly, a first pulse width W1*h* of the first scan pulse SCAN1 output from the gate driving circuit 130 to the first gate line GL1 to be supplied to the first sub-pixel SP1 and a second pulse width W2*h* of the second scan pulse SCAN output from the gate driving circuit 130 to the second gate line GL2 to be supplied to the second sub-pixel SP2 can be different from each other.

Referring to FIG. 7, in the high temperature condition, as the first sub-pixel SP1 of the first sub-pixel SP1 and the second sub-pixel SP2 is located farther away from the data driving circuit 120 or in a more outer edge of the display area DA, a first pulse width W1*r* of the first scan pulse SCAN1 output from the gate driving circuit 130 to the first gate line GL1 connected to the first sub-pixel SP1 can be longer than a second pulse width W2*r* of the second scan pulse SCAN output from the gate driving circuit 130 to the second gate line GL2 connected to the second sub-pixel SP2.

Accordingly, in the high temperature condition, there can occur a difference in pulse widths ΔW between the first pulse width W1*h* of the first scan pulse SCAN1 output from the gate driving circuit 130 to the first gate line GL1 to be supplied to the first sub-pixel SP1 and the second pulse width W2*h* of the second scan pulse SCAN output from the gate driving circuit 130 to the second gate line GL2 to be supplied to the second sub-pixel SP2.

The pulse width difference ΔW corresponds to a difference between respective charging rates (amounts of charge, charging times) of the first sub-pixel SP1 and the second sub-pixel SP2 in high temperature conditions. As the difference between the respective charging rates (amounts of charge, charging times) of the first sub-pixel SP1 and the second sub-pixel SP2 increases, the pulse width difference ΔW can increase. As the difference between the respective charging rates (amounts of charge, charging times) of the first sub-pixel SP1 and the second sub-pixel SP2 decreases, the pulse width difference ΔW can decrease.

In addition, the degree to which an ambient temperature is higher than the room temperature affects such a charging rate (a charging time, an amount of charge). Accordingly, the pulse width difference ΔW can vary depending on how high the ambient temperature is compared to the room temperature. The greater the degree to which the ambient temperature is higher than the room temperature, the bigger the pulse width difference ΔW is. The smaller the degree to which the ambient temperature is higher than the room temperature, the smaller the pulse width difference ΔW is.

Referring to FIG. 8, the charge difference compensation system according to embodiments of the present disclosure can implement a charge difference compensation adaptable to an ambient temperature through a data driving control adaptable to the ambient temperature.

When an ambient temperature is less than a threshold temperature (the room temperature condition), or a difference between respective charging times in the first sub-pixel SP1 and the second sub-pixel SP2 is not substantially made (that is, an event does not occur in which the ambient temperature is higher than or equal to the threshold temperature or a difference between respective charging times in the first sub-pixel SP1 and the second sub-pixel SP2 is made), the data driving circuit 120 can output a first data signal Vdata1 to be supplied to the first sub-pixel SP1 at a first timing t1, and output a second data signal Vdata2 to be supplied to the second sub-pixel SP2 at a second timing t2.

When an event occurs in which the ambient temperature is higher than or equal to the threshold temperature (the high temperature condition) or a difference between respective charging times in the first sub-pixel SP1 and the second sub-pixel SP2 is made (e.g., this difference exists), the charge difference compensation system can implement a data driving control adaptable to the ambient temperature higher than or equal to the threshold temperature. Accordingly, only one of the first timing t1' at which the first data signal Vdata1 is output from the data driving circuit 120 and the second timing t2' at which the second data signal Vdata2 is output from the data driving circuit 120 can be changed according to the occurrence of the event, or while the first timing t1' and the second timing t2' are changed according to the occurrence of the event, the amount of change of the first timing t1' and the amount of change of the second timing t2' can be different from each other.

Referring to FIG. 8, in the high temperature condition, as the first sub-pixel SP1 of the first sub-pixel SP1 and the second sub-pixel SP2 is located farther away from the data driving circuit 120 or in a more outer edge of the display area DA, only the first timing t1' of the first timing t1' and the second timing t2' can be advanced in time according to the occurrence of the event, or while both the first timing t1' and the second timing t2' are advanced in time according to the occurrence of the event, the amount of change ΔT of the first timing t1' can be larger than that of the second timing t2'.

A level of the amount of change ΔT of the first timing t1' according to the occurrence of the event, or a difference between the amount of change of the first timing t1' and the amount of change of the second timing t2' corresponds to a difference between respective charging rates (amounts of charge, or charging times) of the first sub-pixel SP1 and the second sub-pixels SP2.

For example, as a difference between respective charging rates (amounts of charge, charging times) of the first sub-pixel SP1 and the second sub-pixel SP2 is bigger, the amount of change ΔT of the first timing t1' can be larger, or a difference between the amount of change of the first timing t1' and the amount of change of the second timing t2' can be bigger. As a difference between respective charging rates (amounts of charge, charging times) of the first sub-pixel SP1 and the second sub-pixel SP2 is smaller, the amount of change ΔT of the first timing t1' can be smaller, or a difference between the amount of change of the first timing t1' and the amount of change of the second timing t2' can be smaller.

In addition, the degree to which an ambient temperature is higher than the room temperature affects such a charging rate (a charging time, or an amount of charge). Therefore, a level of the amount of change ΔT of the first timing t1' according to the occurrence of the event, or a difference between the amount of change of the first timing t1' and the amount of change of the second timing t2' can be depending on how high the ambient temperature is compared to the room temperature.

For example, the greater the degree to which the ambient temperature is higher than the room temperature, the larger the amount of change ΔT of the first timing t1' can be, or the bigger a difference between the amount of change of the first timing t1' and the amount of change of the second timing t2' can be. The smaller the degree to which the ambient temperature is higher than the room temperature, the smaller the amount of change ΔT of the first timing t1' can be, or the smaller a difference between the amount of change of the first timing t1' and the amount of change of the second timing t2' can be.

Figure 9:
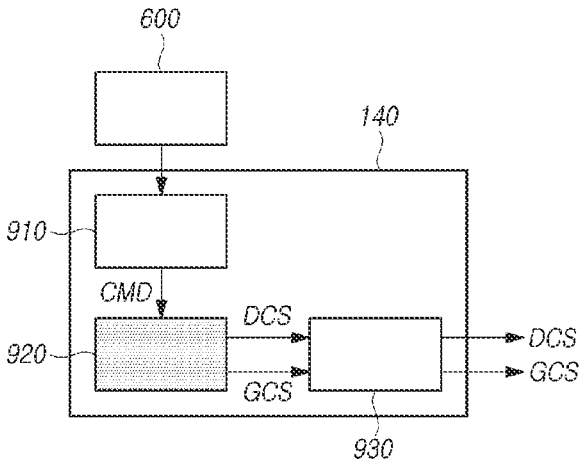
FIG. 9 is a block diagram illustrating a controller for compensating for a difference between charges in the display device according to aspects of the present disclosure.

FIG. 9 is a block diagram illustrating a controller for compensating for charge differences in the display device 100 according to aspects of the present disclosure.

Referring to FIG. 9, the controller 140 according to embodiments of the present disclosure can include a signal adjustment circuit 920 and a signal output circuit 930.

The signal adjustment circuit 920 can adjust a gate driving timing control signal GCS or a data driving timing control signal DCS as a control command signal CMD is input.

The signal output circuit 930 can output the gate driving timing control signal GCS to the gate driving circuit 130 and output the data driving timing control signal DCS to the data driving circuit 120.

Referring to FIG. 9, the controller 140 according to embodiments of the present disclosure can further include a monitoring circuit 910 that outputs the control command signal CMD to the signal adjustment circuit 920 according to variances in ambient temperature or a change in charging times of sub-pixels SP in the display panel 110.

The control command signal CMD can include information on an ambient temperature or variances in temperature, or include information on charging times or changes in charging times.

In the high temperature condition, when the gate driving timing control signal GCS is adjusted, a first pulse width W1*h* of a first scan pulse SCAN1 supplied to a first sub-pixel SP1 of a plurality of sub-pixels SP disposed in the display panel 110 and a second pulse width W2*h* of a scan pulse SCAN of a second sub-pixel SP2 provided to a second sub-pixel SP2 disposed in a different location from the first sub-pixel SP1 among the plurality of sub-pixels SP disposed in the display panel 110 can be different from each other.

Further, in the high temperature condition, when the data driving timing control signal DCS is adjusted, only one of a first timing t1' at which a first data signal Vdata1 to be supplied to the first sub-pixel SP1 of the plurality of sub-pixels SP disposed in the display panel 110 is output from the data driving circuit 120 and a second timing t2' at which a second data signal Vdata2 to be supplied to the second sub-pixel SP2 disposed in a different location from the first sub-pixel SP1 among the plurality of sub-pixels SP disposed in the display panel 110 is output from the data driving circuit 120 can be changed according to the occurrence of an event, or while the first timing t1' and the second timing t2' are changed, the amount of change of the first timing t1' and the amount of change of the second timing t2' can be different from each other.

Figure 10:
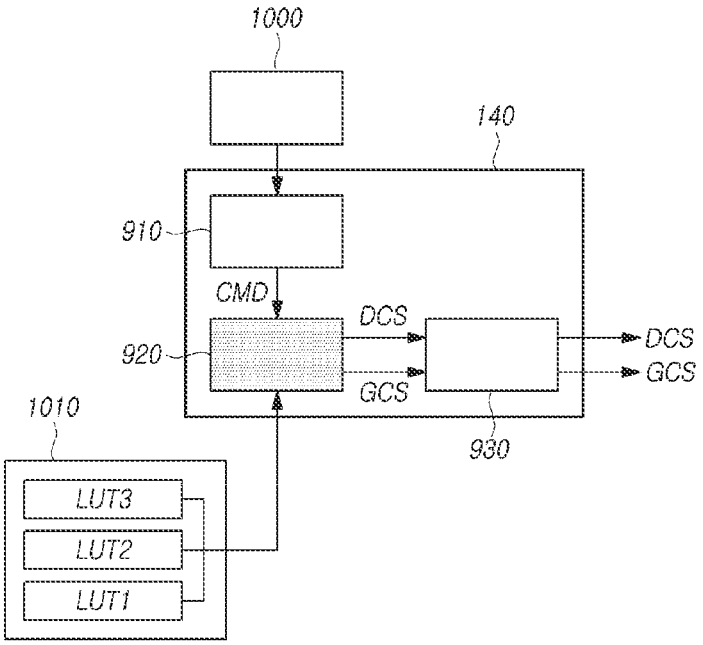
FIG. 10 illustrates a system for compensating for a difference between charges based on a temperature sensor in the display device according to aspects of the present disclosure.

FIG. 10 illustrates a system for compensating for charge differences based on a temperature sensor 1000 in the display device 100 according to aspects of the present disclosure.

Referring to FIG. 10, the charge difference compensation system based on the temperature sensor 1000 can include a temperature sensor 1000 that senses a temperature of the display panel 110 and outputs information on the sensed temperature. The temperature sensor 1000 can be located in various locations of the display device 100. For example, the temperature sensor 1000 can be mounted on the source printed circuit board SPCB or the control printed circuit board CPCB.

The monitoring circuit 910 of the controller 140 can monitor whether an ambient temperature rises to a threshold temperature or more based on the sensed temperature information received from the temperature sensor 1000, and output a control command signal CMD to the signal adjustment circuit 920.

Here, the threshold temperature can be a fixed set value (e.g., 15 degrees Celsius, which is the normal room temperature), or can be changed and re-configured according to a driving situation or the passage of a driving time.

Further, the high temperature condition can be divided into two or more high temperature conditions according to a range of temperature. In this case, the threshold temperature can be set to two or more threshold temperatures. For example, when a first threshold temperature is set to 15 degrees Celsius and a second threshold temperature is set to 50 degrees Celsius, a corresponding temperature condition can include a room temperature condition of less than 15 degrees Celsius, a first high temperature condition of 15 degrees Celsius or more and less than 50 degrees Celsius, and a second high temperature condition of 50 degrees Celsius or more.

Referring to FIG. 10, the charge difference compensation system based on the temperature sensor 1000 can further include a memory 1010 in which two or more lookup tables (LUT1, LUT2, LUT3) are stored. Each of two or more lookup tables (LUT1, LUT2, LUT3) can correspond to a temperature condition (a temperature range or level) different from one another.

For example, a temperature condition can be set to a room temperature condition, a first high temperature condition, and a second high temperature condition, and a first threshold temperature can be set to 15 degrees Celsius, and a second threshold temperature can be set to 50 degrees Celsius. In this case, the room temperature condition can be a temperature condition of less than 15 degrees Celsius, the first high temperature condition can be a temperature condition of 15 degrees Celsius or more and less than 50 degrees Celsius, and the second high temperature condition can be a temperature condition of 50 degrees Celsius or more. According to this example, when a first lookup table LUT1, a second lookup table LUT2, and a third lookup table LUT3 are stored in the memory 1010, the first lookup table LUT1 can be used for charge difference compensation control in the room temperature condition, the second lookup table LUT2 can be used for charge difference compensation control in the first high temperature condition, and the third lookup table LUT3 can be used for charge difference compensation control in the second high temperature condition.

Each of two or more lookup tables (LUT1, LUT2, LUT3) can include information on at least one value of at least one charge difference compensation control parameter corresponding to at least one of a difference ΔW in respective pulse widths of scan pulses SCAN1 and SCAN2 or amounts (or levels) of change ΔT of output timings in a corresponding temperature condition.

When a control command signal CMD is input from the monitoring circuit 910, the signal adjustment circuit 920 of the controller 140 can select one lookup table corresponding to an ambient temperature among two or more lookup tables (LUT1, LUT2, LUT3) stored in the memory 1010, and determine a difference ΔW between a first pulse width W1*h* of a first scan pulse SCAN1 and a second pulse width W2*h* of a second scan pulse SCAN2 based on the locations of the first sub-pixel SP1 and the second sub-pixel SP2 and information included in the control command signal CMD using the selected lookup table, or determine the amount (or level) of change of one of a first timing at which a first data signal Vdata1 is output from the data driving circuit 120 and a second timing at which a second data signal Vdata2 is output from the data driving circuit 120, or a difference ΔT between the amount (or level) of change of the first timing and the amount (or level) of change of the second timing.

The signal adjustment circuit 920 of the controller 140 can generate one or more of a gate driving timing control signal GCS and a data driving timing control signal DCS based on the determined information (ΔW, ΔT, etc.) on the charge difference compensation control parameters.

Accordingly, the signal output circuit 930 outputs the gate driving timing control signal GCS and the data driving timing control signal DCS generated by the signal adjustment circuit 920 to the gate driving circuit 130 and the data driving circuit 120, respectively.

As the gate driving circuit 130 outputs the scan pulses SCAN1 and SCAN2 in the high temperature condition illustrated in FIG. 7 at predetermined timings, and the data driving circuit 120 outputs data signals Vdata1 and Vdata2 in the high temperature condition illustrated in FIG. 8 at predetermined timings, thus, it is possible to cure or reduce a charge difference between the first sub-pixel SP1 and the second sub-pixel SP2.

As described above, the charge difference compensation system based on the charging time sensing of the display device 100 according to aspects of the present disclosure can sense the ambient temperature, and can perform the charge difference compensate control by indirectly determining charging times or a difference between the charging times through the sensed ambient temperature considering that a difference between respective charging times of sub-pixels SP tends to increase as temperature normally rises.

As a different method, the charge difference compensation system based on the charging time sensing of the display device 100 according to aspects of the present disclosure can directly sense charging times (amounts of charge, charging rates) of all sub-pixels SP, or a sub-pixel representatively set for each area, of the display panel 110, and perform the charge difference compensate control based on the sensed charging times. Hereinafter, charge difference compensation methods based on such charging time sensing will be described in more detail with reference to FIGS. 11 and 12.

Figure 11:
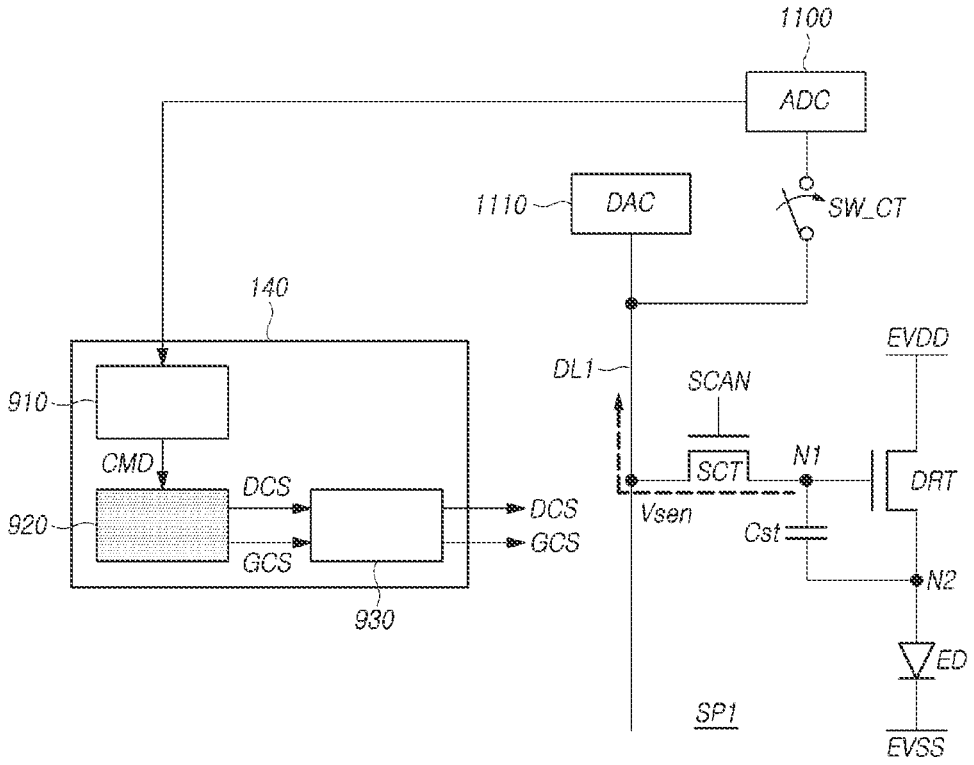
FIG. 11 illustrates a system for compensating for a difference between charges based on charging time sensing in the display device according to aspects of the present disclosure.
Figure 12:
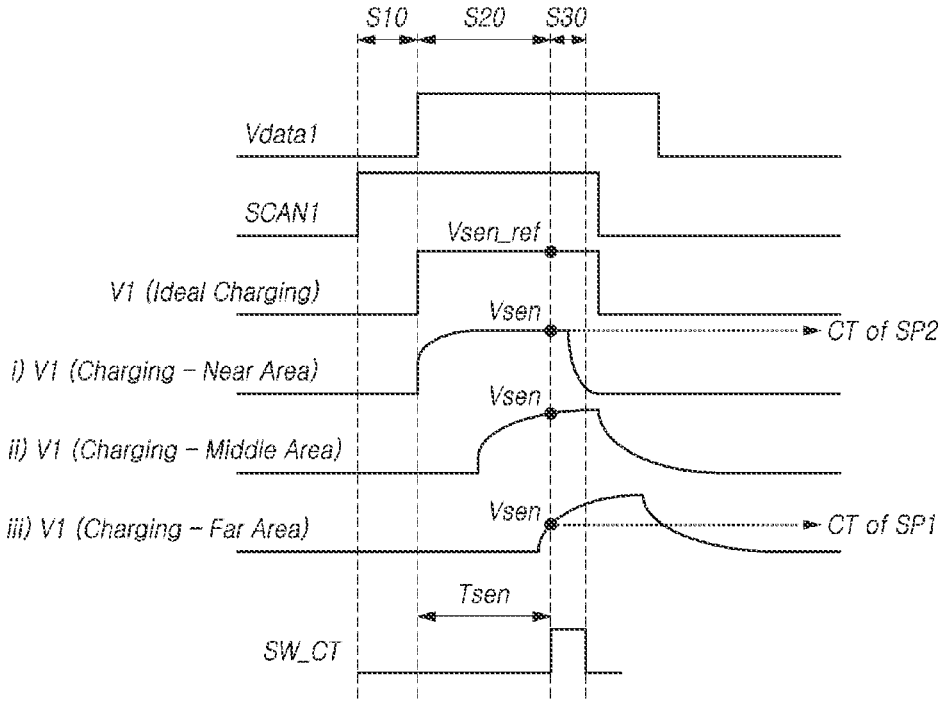
FIG. 12 is a driving timing diagram for sensing a charging time in the display device according to aspects of the present disclosure.

FIG. 11 illustrates a charge difference compensation system based on the charging time sensing in the display device 100 according to aspects of the present disclosure. FIG. 12 is a driving timing diagram for sensing a charging time in the display device 100 according to aspects of the present disclosure.

Hereinafter, discussions are conducted on the first sub-pixel SP1 described in the above several embodiments as an example of sub-pixels SP for which charging time sanding is performed. Further, it is assumed that the first sub-pixel SP1 has a 2T (Transistor) and 1C (Capacitor) structure having two transistors DRT and SCT and one capacitor Cst as shown in FIG. 2A.

Referring to FIG. 11, in the charge difference compensation system based on the charging time sensing of the display device 100 according to aspects of the present disclosure, the monitoring circuit 910 of the controller 140 can sense charging times for each area in the display panel 110, and when it is determined that the respective charging times of a first sub-pixel SP1 and a second sub-pixel SP2 are different from each other based on the sensed results, output a control command signal CMD to the signal adjustment circuit 920.

In order to monitor charging times for each area in the display panel 110, the monitoring circuit 910 can sense all charging times for all sub-pixels SP of the display panel 110, or sense a charging time (an amount of charge, a charging rate) of a sub-pixel SP representatively set for each area (e.g., Af, Am, An, Al, Alc, Arc, and Ar in FIG. 4) of the display panel 110.

Referring to FIG. 11, in order for the monitoring circuit 910 to sense the charging time of the first sub-pixel SP1, the charge difference compensation system can further include an analog-to-digital converter 1100 for sensing a voltage of a first data line DL1 connected to the first sub-pixel SP1, and a charge sensing control switch SW_CT for controlling a connection between the analog-to-digital converter 1100 and the first data line DL1.

The first data line DL1 can be electrically connected to a digital-to-analog converter 1110 included in the data driving circuit 120, and receive a first data signal Vdata1 in the form of analog output from the digital-to-analog converter 1110.

Referring to FIG. 12, a sensing mode period for sensing a charging time of the first sub-pixel SP1 can include a first duration S10 in which a first scan pulse SCAN1 is supplied to the first sub-pixel SP1, a second duration S20 in which a first data signal Vdata1 is supplied to the first sub-pixel SP1, and a third duration S30 in which, after the first data signal Vdata1 is supplied to the first sub-pixel SP1 and then a predefined sensing time Tsen passes, the charge sensing control switch SW_CT becomes turned on, and the analog-to-digital converter 1100 senses a voltage of the first data line DL1.

The sensing mode period for sensing the charging time of the first sub-pixel SP1 can run simultaneously when the first sub-pixel SP1 is driven for image display. For example, during the first duration S10, the first data signal Vdata1 supplied to the first sub-pixel SP1 for sensing a charging time can be a data signal for displaying an image.

As the first duration S10 and the second duration S20 run, a storage capacitor Cst in the first sub-pixel SP1 can charge, i.e., store electric charges. Further, during the third duration S30, the voltage Vsen sensed by the analog-to-digital converter 1100 can correspond to the amount of charge (charge time or charge rate) of the first sub-pixel SP1.

Sensing methods for the charging time will be described in more detail below.

As described above, an ideal charging time of the storage capacitor Cst in the first sub-pixel SP1 corresponds to a time length of a duration in which a turn-on level voltage duration of the first scan pulse SCAN1 and a duration in which the first data signal Vdata1 is applied overlap. Here, when an n-type transistor is employed as a scan transistor SCT, the turn-on level voltage duration of the scan pulse SCAN can be a duration having a high level voltage as shown in FIG. 4. When a p-type transistor is employed as the scan transistor SCT, the turn-on level voltage duration of the scan pulse SCAN can be a duration having a low level voltage.

Considering the equation (Q=CV) between the amount of electric charge (Q), capacitance (C), and potential difference (V) of the capacitor in the electric circuit, when the first sub-pixel SP is driven, the amount of electric charge stored by the storage capacitor Cst can be proportional to a potential difference between both terminals thereof. For example, the amount of electric charge stored by the storage capacitor Cst can be proportional to a potential difference between first and the second nodes N1 and N2 of the corresponding driving transistor DT. When it is assumed that a constant voltage is applied to the second node N2 of the driving transistor DT, the amount of charge of the storage capacitor Cst can be proportion to a voltage V1 of the first node N1 of the driving transistor DRT, which is one of both terminals of the storage capacitor Cst.

Accordingly, in a state where the storage capacitor Cst in the first sub-pixel SP1 is charged for a predetermined sensing time Tsen, charging characteristics (the amount of charge, the charging time, and the charging rate) of the storage capacitor Cst in the first sub-pixel SP1 can be determined through a sensing voltage Vsen corresponding to the voltage V1 of the first node N1 of the driving transistor DRT is performed.

When sensing for the charging of the second sub-pixel SP2 located in a near area is driven, a corresponding sensing voltage Vsen can be substantially the same as or similar to a sensing voltage Vsen_ref in an ideal charging state.

This has the following meanings. As charging for the second sub-pixel SP2 located in the near area is normally performed, therefore, the amount of charge of the second sub-pixel SP2 can be substantially the same as or similar to an amount of charge in the ideal charging state. Further, the charging time CT of the second sub-pixel SP2 can be substantially the same as or similar to a charging time in the ideal charging state, and the charging rate of the second sub-pixel SP2 can be substantially the same as or similar to a charging rate in the ideal charging state.

When sensing for the charging of a sub-pixel SP located in a middle area is driven, a corresponding sensing voltage Vsen can become lower than the sensing voltage Vsen_ref in the ideal charging state.

This has the following meanings. As charging for the sub-pixel SP located in the middle area is slightly insufficiently performed, therefore, the amount of charge of the corresponding sub-pixel SP can become slightly smaller than the amount of charge in the ideal charging state. Further, the charging time CT of the sub-pixel SP can become slightly shorter than the charging time in the ideal charging state, and the charging rate of the sub-pixel SP can become slightly lower than the charging rate in the ideal charging state.

When sensing for the charging of the first sub-pixel SP1 located in a far area is driven, a corresponding sensing voltage Vsen can become significantly lower than the sensing voltage Vsen_ref in the ideal charging state.

This has the following meanings. As charging for the first sub-pixel SP1 located in the far area is significantly insufficiently performed, therefore, the amount of charge of the first sub-pixel SP1 can become significantly smaller than the amount of charge in the ideal charging state. Further, the charging time CT of the first sub-pixel SP1 can become significantly shorter than the charging time in the ideal charging state, and the charging rate of the first sub-pixel SP1 can become significantly lower than the charging rate in the ideal charging state.

Referring to FIGS. 11 and 12, after the first data signal Vdata1 is supplied to the first sub-pixel SP1 and then a predefined sensing time Tsen passes, the analog-to-digital converter 1100 senses the voltage V1 of the first node N1 of the driving transistor DRT electrically connected to the first data line DL1 as a sensing voltage Vsen through the scan transistor SCT that is turned on, convert the obtained sensing voltage Vsen into a digital sensing value, and then output the resulting digital sensing value.

Based on the relationship between the sensing voltage Vsen and at least one charging characteristic (an amount of charge, a charging time, and a charging rate) and the digital sensing value, the monitoring circuit 910 of the controller 140 can determine the charging characteristic (the amount of charge, the charging time, and the charging rate) of the storage capacitor Cst in the first sub-pixel SP1.

As described above, as sub-pixels SP are located farther away from the corresponding data driving circuit 120, resulting sensing voltages Vsen can become lower, and as the sub-pixels SP are located closer to the data driving circuit 120, resulting sensing voltages Vsen can become higher. Further, the worse charging characteristics (e.g., the shorter a charging time, the smaller an amount of charge, the lower a charging rate), the lower resulting sensing voltages Vsen become, and the better charging characteristics (the longer a charging time, the larger an amount of charge, the higher a charging rate, the higher sensing voltages Vsen become.

Figure 13:
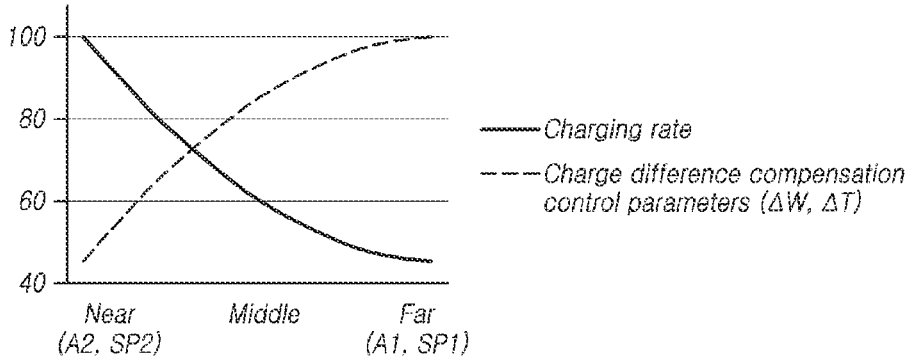
FIG. 13 is a graph illustrating charging rates and values of charge difference compensation control parameters for each location of sub-pixels in the display device according to aspects of the present disclosure.

FIG. 13 is a graph illustrating charging rates (charging rates before charge difference compensation control is performed) and values of charge deviation compensation control parameters (ΔW, ΔT) for each location of sub-pixels SP in the display device 100 according to aspects of the present disclosure.

Referring to FIG. 13, when considering the relationship between locations of sub-pixels SP and corresponding sensing voltages Vsen and the relationship between the sensing voltages Vsen and corresponding charging characteristics (an amount of charge, a charging time, and a charging rate), the first sub-pixel SP1 located in the far area A1 has a low charging rate (a short charging time, or a small amount of charge). The second sub-pixel SP2 located in the near area A2 has a high charging rate (a long charging time, or a large amount of charge.

The lower the charging rate (the smaller the amount of charge, the shorter the charging time), the larger values of the charge difference compensation control parameters (ΔW, ΔT) can become, and the higher the charging rate (the larger the amount of charge, the longer the charging time), the smaller values of the charge difference compensation control parameters (ΔW, ΔT) can become.

Accordingly, the first sub-pixel SP1 located in the far area A1 can have large values of charge difference compensation control parameters (ΔW, ΔT), and the second sub-pixel SP2 located in the near area A2 can have small values of charge difference compensation control parameters (ΔW, ΔT).

Figure 14:
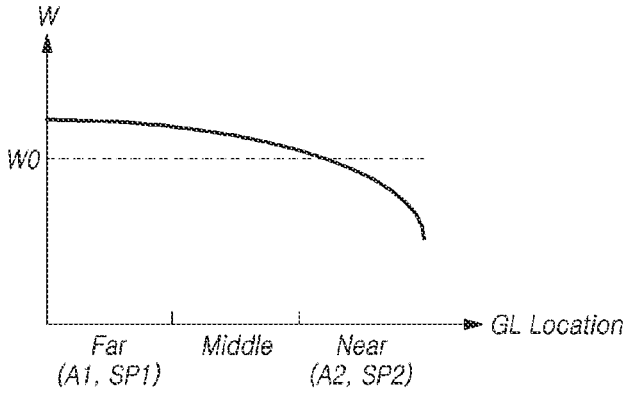
FIG. 14 is a graph illustrating pulse widths of scan pulses according to locations of gate lines in the display device according to aspects of the present disclosure.

FIG. 14 is a graph illustrating pulse widths W of scan pulses SCAN according to locations of gate lines in the display device 100 according to aspects of the present disclosure.

Referring to FIG. 14, when considering the relationship between locations of sub-pixels SP and corresponding sensing voltages Vsen and the relationship between the sensing voltages Vsen and corresponding charging characteristics (an amount of charge, a charging time, and a charging rate), the first sub-pixel SP1 located in the far area A1 has a low charging rate (a short charging time, or a small amount of charge). The second sub-pixel SP2 located in the near area A2 has a high charging rate (a long charging time, or a large amount of charge.

The lower the charging rate (the smaller the amount of charge, the shorter the charging time), the longer a scan pulse width W that is one of charge difference compensation control parameters can become, and the higher the charging rate (the larger the amount of charge, the longer the charging time), the smaller the scan pulse width W can become. Here, a reference scan pulse width W0 is a scan pulse width before charge difference compensation control is performed.

Accordingly, the first sub-pixel SP1 located in the far area A1 can be controlled to have a scan pulse width W longer than the reference scan pulse width W0. In contrast, the second sub-pixel SP2 located in the near area A2 can be controlled to have a scan pulse width W smaller than the reference scan pulse width W0.

Figure 15:
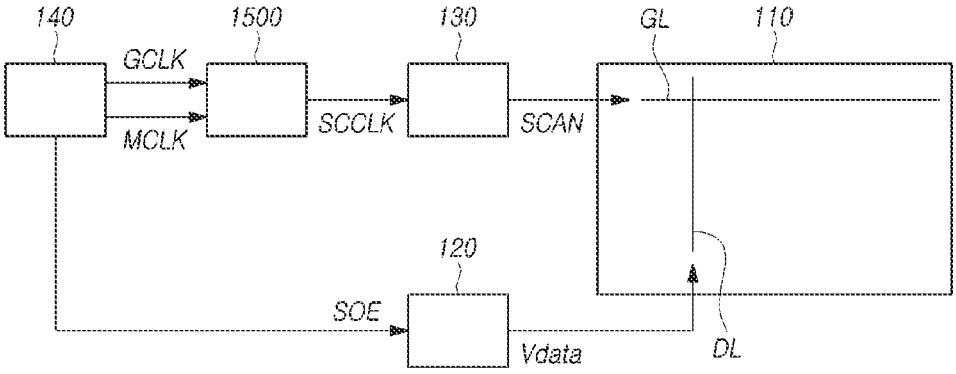
FIG. 15 illustrates a control mechanism for compensating for a difference between charges using a control signal of the controller in the display device according to aspects of the present disclosure.

FIG. 15 illustrates a charge difference compensation control mechanism using a control signal of the controller 140 in the display device 100 according to aspects of the present disclosure.

Referring to FIG. 15, the controller 140 can supply a gate driving timing control signal GCS including a generation clock signal GCLK and a modulation clock signal MCLK to a level shifter 1500.

The level shifter 1500 can generate a scan clock signal SCCLK by using the generation clock signal GCLK and the modulation clock signal MCLK included in the gate driving timing control signal GCS, and supply the generated signal SCCLK to the gate driving circuit GCS.

The gate driving circuit 130 can generate a scan pulse SCAN by using the scan clock signal SCCLK, and supply the generated scan pulse SCAN to a corresponding gate line GL disposed on the display panel 110. Accordingly, a sub-pixel SP connected to the corresponding gate line GL can receive the scan pulse SCAN.

The level shifter 1500 can be included outside of the gate driving circuit 130 or can be included inside of the gate driving circuit 130.

Referring to FIG. 15, the controller 140 can supply a source output enable signal SOE to the data driving circuit 120.

The data driving circuit 120 can generate a data signal Vdata by using the source output enable signal SOE, and supply the generated data signal Vdata to a corresponding data line DL disposed on the display panel 110. Accordingly, a sub-pixel SP connected to the corresponding data line DL can receive the data signal Vdata.

Referring to FIGS. 15 and 7 together, when an ambient temperature rises to a threshold temperature or more, the controller 140 can output a changed gate driving timing control signal GCS, and thereby cause a first pulse width W1*h* of a first scan pulse SCAN1 supplied to a first sub-pixel SP1 and a second pulse width W2*h* of a second scan pulse SCAN supplied to a second sub-pixel SP2 to be different from each other.

For example, the controller 140 can output a changed pulse timing resulting from changing a pulse timing of at least one of the generation clock signal GCLK and the modulation clock signal MCLK as a gate driving timing control signal GCS, and thereby, cause the first pulse width W1*h* and the second pulse width W2*h* to be different.

Referring to FIGS. 15 and 8 together, when an event occurs in which an ambient temperature is higher than or equal to the threshold temperature or a difference between respective charging times of a first sub-pixel SP1 and a second sub-pixel SP2 is made, the controller 140 can output a changed data driving timing control signal DCS, and thereby, cause only one of a first timing t1' and a second timing t2' to be changed according to the occurrence of an event (a high temperature condition, a charge difference occurrence, or the like), or cause the amount of change of the first timing t1' and the amount of change of the second timing t2' to be different from each other while the first timing t1' and the second timing t2' are changed according to the occurrence of the event. Here, the first timing t1' is a timing at which the data driving circuit 120 outputs a first data signal Vdata1 to be supplied to the first sub-pixel SP1. The second timing t2' is a timing at which the data driving circuit 120 outputs a second data signal Vdata2 to be supplied to the second sub-pixel SP2.

For example, the controller 140 can output a changed pulse timing resulting from changing a pulse timing of the source output enable signal SOE as a data driving timing control signal DCS, and thereby, cause the first timing t1' and the second timing t2' to be different.

Figure 16:
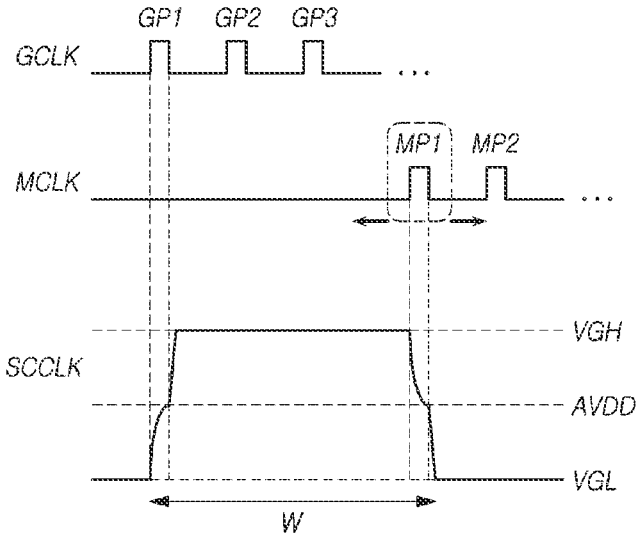
FIG. 16 illustrates a method of controlling a pulse width of a scan pulse using a gate driving timing control signal of the controller in the display device according to aspects of the present disclosure.

FIG. 16 illustrates a method of the controller 140 for controlling a pulse width of a scan pulse SCAN using a gate driving timing control signal GCS in the display device 100 according to aspects of the present disclosure.

Referring to FIG. 16, the generation clock signal GCLK can include a plurality of generation pulses (GP1, GP2, GP3, etc.), and the modulation clock signal MCLK can include a plurality of modulation pulses (MP1, MP2, etc.).

The level shifter 1500 can generate a scan clock signal SCCLK by using the first generation pulse GP1 of the generation clock signal GCLK and the first modulation pulse MP1 of the modulation clock signal MCLK.

Likewise, the level shifter 1500 can generate another scan clock signal SCCLK by using the second generation pulse GP2 of the generation clock signal GCLK and the second modulation pulse MP2 of the modulation clock signal MCLK.

In relation to the generation of the scan clock signal SCCLK, when a voltage level of the first generation pulse GP1 of the generation clock signal GCLK rises, a voltage level of the scan clock signal SCCLK rises. Further, when a voltage level of the first modulation pulse MP1 of the modulation clock signal MCLK rises, the voltage level of the scan clock signal SCCLK falls.

Accordingly, a turn-on level voltage duration (e.g., a high level voltage duration) of the scan clock signal SCCLK can be defined. The scan clock signal SCCLK is supplied to the gate driving circuit 130 and output as a scan pulse SCAN at a predetermined timing.

Accordingly, a turn-on level voltage duration (e.g., a high level voltage duration) in the scan pulse SCAN is substantially the same as the turn-on level voltage duration (e.g., the high level voltage duration) of the scan clock signal SCCLK. As a result, the pulse width W of the scan clock signal SCCLK is substantially the same as the pulse width W of the scan pulse SCAN.

Referring to FIG. 16, the pulse width W of the scan clock signal SCCLK can be adjusted to be longer by shifting a timing of at least one of the plurality of generation pulses (GP1, GP2, GP3, etc.) included in the generation clock signal GCLK to an earlier timing, or by shifting a timing of at least one of the plurality of modulation pulses (MP1, MP2, etc.) included in the modulation clock signal MCLK to a later timing. Accordingly, the pulse width W of the scan pulse SCAN can be adjusted to be lengthened.

Referring to FIG. 16, the pulse width W of the scan clock signal SCCLK can be adjusted to be shorter by shifting a timing of at least one of the plurality of generation pulses (GP1, GP2, GP3, etc.) included in the generation clock signal GCLK to a later timing, or by shifting a timing of at least one of the plurality of modulation pulses (MP1, MP2, etc.) included in the modulation clock signal MCLK to an earlier timing. Accordingly, the pulse width W of the scan pulse SCAN can be adjusted to be shortened.

Referring to FIGS. 16 and 7 together, when an ambient temperature rises to the threshold temperature or more, the controller 140 can output a changed pulse timing resulting from changing a pulse timing of at least one of the generation clock signal GCLK and the modulation clock signal MCLK as a gate driving timing control signal GCS, and thereby, cause a first pulse width W1*h* of a first scan pulse SCAN1 supplied to a first sub-pixel SP1 and a second pulse width W2*h* of a second scan pulse SCAN supplied to a second sub-pixel SP2 to be different from each other.

Figure 17:
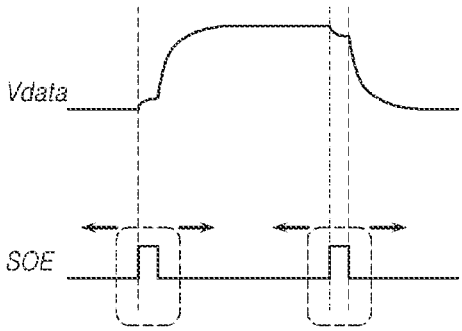
FIG. 17 illustrates a method of controlling an output timing of a data signal using a data driving timing control signal of the controller in the display device according to aspects of the present disclosure.

FIG. 17 illustrates a method of the controller 140 for controlling an output timing of a data signal Vdata using a data driving timing control signal DCS in the display device 100 according to aspects of the present disclosure.

Referring to FIG. 17, a source output enable signal SOE output as a data driving timing control signal from the controller 140 can include a plurality of pulses.

The data driving circuit 120 can output a data signal Vdata during an interval between a first pulse and a second pulse of the source output enable signal SOE.

Accordingly, the controller 140 can adjust at least one of respective pulse timings of the first pulse and the second pulse of the source output enable signal SOE, and thereby, cause a timing at which a data signal Vdata is output from the data driving circuit 120 to be adjusted.

For example, the controller 140 can output changed source output enable signals SOE resulting from advancing respective pulse timings of the first pulse and the second pulse of the source output enable signal SOE to an earlier time, and thereby, cause a timing at which a data signal Vdata is output from the data driving circuit 120 to be advanced.

In another example, the controller 140 can output changed source output enable signals SOE resulting from delaying respective pulse timings of the first pulse and the second pulse of the source output enable signal SOE to a later time, and thereby, cause a timing at which a data signal Vdata is output from the data driving circuit 120 to be delayed.

When the data driving circuit 120 includes two or more source driver integrated circuits SDIC1 to SDIC4, the charge difference compensation control through the above-described data driving timing control can be performed independently for each of the two or more source driver integrated circuits SDIC1 to SDIC4.

Figure 18:
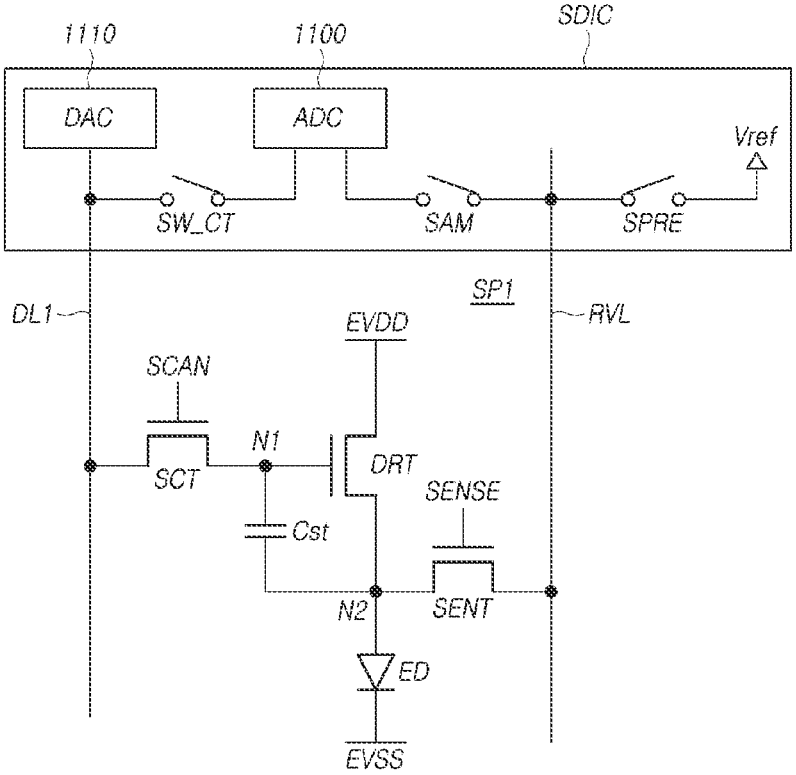
FIG. 18 illustrates a sensing circuit for charging time sensing and element degradation sensing in the display device according to aspects of the present disclosure.

FIG. 18 illustrates a sensing circuit for charging time sensing and element degradation sensing in the display device 100 according to aspects of the present disclosure.

When a first sub-pixel SP1 has the 2T and 1C structure, a circuit for sensing a charging time of the first sub-pixel SP1 can be configured as shown in FIG. 11.

When the first sub-pixel SP1 has a 3T (Transistor) and 1C (Capacitor) structure including three transistors (DRT, SCT, and SENT) and one capacitor Cst as shown in FIG. 2B, a circuit for sensing a charging time of the first sub-pixel SP1 can be configured as shown in FIG. 18.

The 3T and 1C structure can be effectively used for sensing a threshold voltage or mobility of a driving transistor DRT in the first sub-pixel SP1 or a threshold voltage of a light emitting element ED such as an organic light emitting diode in the first sub-pixel SP, and compensating for such threshold voltages or mobility based on the sensed results.

Accordingly, when the first sub-pixel SP1 has the 3T and 1C structure, the display device 100 can further include an initialization switch SPRE that controls a connection between a reference voltage line RVL and a node to which a reference voltage Vref is applied, and a sampling switch SAM for controlling a connection between the reference voltage line RVL and an analog-to-digital converter (ADC, 1100).

The driving for sensing the threshold voltage of the driving transistor DRT will be briefly described as follows. The driving for sensing the threshold voltage can include an initialization step, a tracking step, and a sampling step.

In the initialization step, the scan transistor SCT and the sensing transistor SENT become turned on, and the initialization switch SPRE becomes turned on. Accordingly, a data voltage for sensing driving and a reference voltage Vref are applied to first and second nodes N1 and N2 of the driving transistor DRT, respectively.

In the tracking step, the initialization switch SPRE becomes turned off, leading the second node N2 of the driving transistor DRT to be electrically floated. Accordingly, a voltage at the second node N2 of the driving transistor DRT rises from the reference voltage Vref. In this situation, the data voltage for sensing driving (a constant voltage) is applied to the first node N1 of the driving transistor DRT.

The voltage rising at the second node N2 of the driving transistor DRT continues until a voltage difference between the first node N1 and the second node N2 of the driving transistor DRT reaches the threshold voltage of the driving transistor DRT.

When the voltage rising at the second node N2 of the driving transistor DRT stops, and the voltage of the second node N2 of the driving transistor DRT is saturated, then, the sampling step is initiated.

In the sampling step, the sampling switch SAM becomes turned on, and the analog-to-digital converter 1100 is electrically connected to the reference voltage line RVL to sense the voltage of the reference voltage line RVL. The voltage sensed by the analog-to-digital converter 1100 equals to a voltage value obtained by subtracting the threshold voltage of the driving transistor DRT from the data voltage for sensing driving. Accordingly, as the data voltage for sensing driving is a known value, the threshold voltage of the driving transistor DRT can be calculated from the sensed voltage and the data voltage for sensing driving. Such calculating processing can be performed by the controller 140.

As described above, the analog-to-digital converter 1100 can be used to sense the voltage of the reference voltage line RVL in order to sense degradation of the driving transistor DRT or the light emitting element ED. Further, as described above, the analog-to-digital converter 1100 can also be used to sense a voltage of a first data line DL1 for sensing a charging time. Further, the sensing of the degradation of the driving transistor DRT or the light emitting element ED and the sensing of the charging time cannot be performed simultaneously.

Accordingly, the charge sensing control switch SW_CT and the sampling switch SAM cannot be simultaneously turned on. When the charge sensing control switch SW_CT is turned on, the sampling switch SAM is in a turn-off state, and when the sampling switch SAM is turned on, the charge sensing control switch SW_CT is in a turn-off state.

Figure 19:
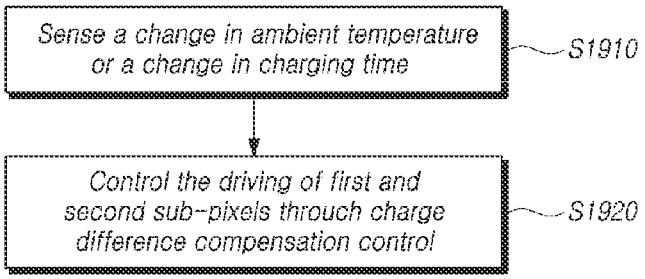
FIG. 19 is a flow diagram illustrating a display driving method in the display device according to aspects of the present disclosure.

FIG. 19 is a flow diagram illustrating a display driving method by the display device 100 according to aspects of the present disclosure.

Referring to FIG. 19, the display driving method of the display device 100 according to aspects of the present disclosure can include, by sensing a change in ambient temperature or a change in charging times of a plurality of sub-pixels SP in the display panel 110, sensing whether an event occurs in which the ambient temperature is higher than or equal to a threshold temperature, or a difference between respective charging times of two or more sub-pixels of the sub-pixels is made, at step S1910, performing sub-pixel driving through charge difference compensation control based on the sensed result for the change in the ambient temperature or the change in charging times of the sub-pixels SP, at step S1920, and the like.

In step S1920, according to a first vertical synchronization signal, the gate driving circuit 120 can supply a first scan pulse SCAN1 to a first sub-pixel SP1, and the data driving circuit 120 can supply a first data signal Vdata1 to the first sub-pixel SP1.

In step S1920, according to a second vertical synchronization signal, the gate driving circuit 120 can supply a second scan pulse SCAN2 to a second sub-pixel SP2 disposed in a row or column different from the first sub-pixel SP1, and the data driving circuit 120 can supply a second data signal Vdata2 to the second sub-pixel SP2.

According to the display driving method of the display device 100 according to aspects of the present disclosure, a first pulse width W1*h* of the first scan pulse SCAN1 supplied to the first sub-pixel SP1 and a second pulse width W2*h* of the second scan pulse SCAN supplied to the second sub-pixel SP2 can be different from each other.

According to the display driving method of the display device 100 according to aspects of the present disclosure, only one of a first timing at which a first data signal Vdata1 to be supplied to the first sub-pixel SP1 is output from the data driving circuit 120 and a second timing at which a second data signal Vdata2 to be supplied to the second sub-pixel SP2 is output from the data driving circuit 120 can be changed according to the occurrence of an event, or while the first timing and the second timing are changed, the amount of change of the first timing and the amount of change of the second timing can be different from each other.

When the first sub-pixel SP1 of the first sub-pixel SP1 and the second sub-pixel SP2 is located farther away from the data driving circuit 120 or in a more outer edge of the display area DA, a first pulse width W1*h* of the first scan pulse SCAN1 supplied to the first sub-pixel SP1 is used as the first sub-pixel SP1 can be longer than a second pulse width W2*h* of the second scan pulse SCAN supplied to the second sub-pixel SP2.

When the first sub-pixel SP1 of the first sub-pixel SP1 and the second sub-pixel SP2 is located farther away from the data driving circuit 120 or in a more outer edge of the display area DA, only the first timing of a first timing at which a first data signal Vdata1 to be supplied to the first sub-pixel SP1 is output from the data driving circuit 120 and a second timing at which a second data signal Vdata2 to be supplied to the second sub-pixel SP2 is output from the data driving circuit 120 can be advanced according to the occurrence of the event, or while the first timing and the second timing are advanced according to the occurrence of the event, the first timing can be more advanced than the second timing.

Further, in a situation where the first sub-pixel SP1 of the first sub-pixel SP1 and the second sub-pixel SP2 is located farther away from the data driving circuit 120 or in a more outer edge of the display area DA, when an event occurs, a length of an image signal voltage duration (a length of a horizontal time) of a first data signal Vdata1 output from the data driving circuit 120 can be longer than a length of an image signal voltage duration (a length of a horizontal time) of a second data signal Vdata2 output from the data driving circuit 120.

According to the embodiments described herein, it is possible to provide display devices 100, controllers 140, and display driving methods for compensating for a difference between respective charges of sub-pixels SP.

According to the embodiments described herein, it is possible to provide display devices 100, controller 140, and display driving methods for compensating for a difference between respective charges of sub-pixels SP that is made in a high temperature condition.

According to the embodiments described herein, it is possible to provide display devices 100, controllers 140, and display driving methods for compensating for a difference between respective charges of sub-pixels SP disposed in different locations.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein can be applied to other embodiments and applications without departing from the spirit and scope of the present invention. The above description and the accompanying drawings provide an example of the technical idea of the present invention for illustrative purposes only. For example, the disclosed embodiments are intended to illustrate the scope of the technical idea of the present invention. Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A display device comprising:

a display panel in which a plurality of data lines and a plurality of gate lines are disposed, the display panel including a plurality of sub-pixels;

a data driving circuit configured to output a first data signal and a second data signal;

a gate driving circuit configured to output a first scan pulse and a second scan pulse;

a controller configured to control the data driving circuit and the gate driving circuit; and a monitoring circuit configured to sense a charging time for each area in the display panel, and when it is determined that respective charging times of first and second sub-pixels among the plurality of sub-pixels are different from each other based on the sensed result, output a control command signal, wherein the plurality of sub-pixels includes a first sub-pixel and a second sub-pixel disposed in different locations, and the first sub-pixel and the second sub-pixel are disposed in different sub-pixel rows or columns, and wherein when an event occurs in which an ambient temperature is higher than or equal to a threshold temperature, a first pulse width of a first scan pulse output from the gate driving circuit to a first gate line connected to the first sub-pixel and a second pulse width of a second scan pulse output from the gate driving circuit to a second gate line connected to the second sub-pixel are different from each other, or only one of a first timing at which a first data signal to be supplied to the first sub-pixel is output from the data driving circuit and a second timing at which a second data signal to be supplied to the second sub-pixel is outputted from the data driving circuit is changed according to the occurrence of the event.

2. The display device according to claim 1, wherein when the first sub-pixel among the first sub-pixel and the second sub-pixel is located farther away from the data driving circuit or is located in a more outer edge, the first pulse width of the first scan pulse output from the gate driving circuit to the first gate line connected to the first sub-pixel is longer than the second pulse width of the second scan pulse output from the gate driving circuit to the second gate line connected to the second sub-pixel.

3. The display device according to claim 1, wherein when the first sub-pixel among the first sub-pixel and the second sub-pixel is located farther away from the data driving circuit or is located more outer edge, only the first timing among the first timing and the second timing is advanced according to the occurrence of the event, or while the first timing and the second timing are advanced, the first timing is more advanced than the second timing.

4. The display device according to claim 1, wherein a difference between a charging time of the first sub-pixel and a charging time of the second sub-pixel when the ambient temperature rises to the threshold temperature or more is bigger than a difference between a charging time of the first sub-pixel and a charging time of the second sub-pixel when the ambient temperature is less than the threshold temperature.

5. The display device according to claim 1, further comprising:

a temperature sensor configured to sense a temperature of the display panel and output information on the sensed temperature; and a monitoring circuit configured to monitor whether the ambient temperature rises to the threshold temperature or more based on the sensed temperature information, and output a control command signal.

6. The display device according to claim 1, further comprising a memory in which two or more lookup tables corresponding to different temperature conditions are stored, wherein each of the two or more lookup tables includes information on at least one value of at least one charge difference compensation control parameter corresponding to at least one of a difference between respective pulse widths of scan pulses and a difference between respective output timings of data signals in a corresponding temperature condition, and wherein using a lookup table corresponding to the ambient temperature among the two or more lookup tables, the controller determines a difference between the first pulse width of the first scan pulse and the second pulse width of the second scan pulse, or determines an amount of change of one of the first timing and the second timing or a difference between an amount of change of the first timing and an amount of change of the second timing.

7. The display device according to claim 1, further comprising:

an analog-to-digital converter configured to sense a voltage of a first data line connected to the first sub-pixel; and a charge sensing control switch configured to switch a connection between the analog-to-digital converter and the first data line, wherein a sensing mode period for sensing a charging time of the first sub-pixel includes a first duration in which the first scan pulse is supplied to the first sub-pixel, a second duration in which the first data signal is supplied to the first sub-pixel, and a third duration in which after the first data signal is supplied to the first sub-pixel, and a predetermined sensing time passes, the charge sensing control switch becomes turned on, and the analog-to-digital converter senses the voltage of the first data line, and wherein during the third duration, the voltage sensed by the analog-to-digital converter corresponds to the amount of charge of the first sub-pixel.

8. The display device according to claim 1, wherein when the ambient temperature rises to the threshold temperature or more, the controller outputs a changed gate driving timing control signal, and thereby, causes the first pulse width of the first scan pulse output from the gate driving circuit and the second pulse width of the second scan pulse output from the gate driving circuit to be different from each other.

9. The display device according to claim 8, wherein the controller outputs a changed pulse timing resulting from changing a pulse timing of at least one of a generation clock signal and a modulation clock signal as the changed gate driving timing control signal, and thereby, causes the first pulse width and the second pulse width to be different.

10. The display device according to claim 1, wherein when the ambient temperature rises to the threshold temperature or more, the controller outputs a changed data driving timing control signal, and thereby, causes only one of the first timing and the second timing to be changed according to the occurrence of the event, or causes an amount of change of the first timing and an amount of change of the second timing to be different while the first timing and the second timing are changed according to the occurrence of the event.

11. The display device according to claim 10, wherein the controller outputs a changed pulse timing resulting from changing a pulse timing of a source output enable signal as the changed data driving timing control signal, and thereby, causes only one of the first timing and the second timing to be changed according to the occurrence of the event, or causes the amount of change of the first timing and the amount of change of the second timing to be different while the first timing and the second timing are changed according to the occurrence of the event.

12. A controller for controlling driving of a display panel, the controller comprising:

a signal output circuit configured to output a gate driving timing control signal to a gate driving circuit, and output a data driving timing control signal to a data driving circuit; and a signal adjustment circuit configured to adjust the gate driving timing control signal or the data driving timing control signal when an event occurs in which an ambient temperature is higher than or equal to a threshold temperature, or a difference between a charging time of a first sub-pixel of a plurality of sub-pixels and a charging time of a second sub-pixel thereof exists, wherein a difference between a charging time of the first sub-pixel and a charging time of the second sub-pixel when the ambient temperature rises to a threshold temperature or more is bigger than a difference between a charging time of the first sub-pixel and a charging time of the second sub-pixel when the ambient temperature is less than the threshold temperature.

13. The controller according to claim 12, wherein the data driving timing control signal is a source output enable signal.

14. The controller according to claim 12, wherein when the gate driving timing control signal is adjusted, a first pulse width of a first scan pulse output from the gate driving circuit to a first gate line connected to the first sub-pixel of the plurality of sub-pixels disposed in the display panel is different from a second pulse width of a second scan pulse output from the gate driving circuit to a second gate line connected to the second sub-pixel different from the first sub-pixel.

15. The controller according to claim 12, wherein when the data driving timing control signal is adjusted, only one of a first timing at which a first data signal to be supplied to the first sub-pixel of the plurality of sub-pixels disposed in the display panel is output from the data driving circuit and a second timing at which a second data signal to be supplied to the second sub-pixel disposed in a different location from the first sub-pixel is output from the data driving circuit is changed according to the occurrence of the event, or while the first timing and the second timing are changed according to the occurrence of the event, an amount of change of the first timing and an amount of change of the second timing are different from each other.

16. A display device comprising:

a display panel in which a plurality of data lines and a plurality of gate lines are disposed, the display panel including a plurality of sub-pixels;

a data driving circuit configured to output a first data signal to a first data line of the plurality of data lines and a second data signal to a second data line of the plurality of data lines;

a gate driving circuit configured to output a first scan pulse to a first gate line of the plurality of gate lines; and a controller configured to control the data driving circuit and the gate driving circuit, wherein when an ambient temperature rises to a predetermined degree or more, a pulse width of the first scan pulse output from the gate driving circuit to the first gate line connected to a first sub-pixel of the plurality of sub-pixels is increased compared with when the temperature was lower than the predetermined degree, or a first timing at which the first data signal to be supplied to the first sub-pixel is output from the data driving circuit is advanced compared with when the temperature was lower than the predetermined degree, and wherein when the ambient temperature rises to the predetermined degree or more, the controller is configured to output a changed data driving timing control signal, and thereby, cause only one of the first timing and a second timing at which the second data signal to be supplied to a second sub-pixel of the plurality of sub-pixels is output from the data driving circuit to be changed, or an amount of change of the first timing and an amount of change of the second timing to be different while the first timing and the second timing are changed.

17. A display driving method of a display device including a display panel in which a plurality of data lines and a plurality of gate lines are disposed and having a plurality of sub-pixels, a data driving circuit configured to output data signals to the plurality of data lines, and a gate driving circuit configured to output scan pulses to at least one of the plurality of gate lines, the display driving method comprising:

sensing whether an event occurs in which an ambient temperature is higher than or equal to a threshold temperature; and supplying a first scan pulse and a first data signal to a first sub-pixel among the plurality of sub-pixels and supplying a second scan pulse and a second data signal to a second sub-pixel among the plurality of sub-pixels, wherein only one of a first timing at which the first data signal to be supplied to the first sub-pixel is output from the data driving circuit and a second timing at which the second data signal to be supplied to the second sub-pixel is outputted from the data driving circuit is changed according to the occurrence of the event.

18. The display driving method according to claim 17, wherein when the first sub-pixel among the first sub-pixel and the second sub-pixel is located farther away from the data driving circuit or is located in a more outer edge.

19. The display driving method according to claim 17, wherein when the first sub-pixel among the first sub-pixel and the second sub-pixel is located farther away from the data driving circuit or is located more outer edge, only the first timing among the first timing and the second timing is advanced according to the occurrence of the event, or while the first timing and the second timing are advanced, the first timing is more advanced than the second timing.

* * * * *